US010167640B2

(12) United States Patent
Pekovsek et al.

(10) Patent No.: US 10,167,640 B2
(45) Date of Patent: Jan. 1, 2019

(54) CHANGEOVER COVER WITH PLUG CONNECTION

(71) Applicant: WEITZER HOLDING GMBH, Weiz (AT)

(72) Inventors: Michael Pekovsek, Fohnsdorf (AT); Gottfried Steiner, Spielberg (AT)

(73) Assignee: Weitzer Holding GmbH, Weiz (AT)

( * ) Notice: Subject to any disclaimer, the term of this patent is extended or adjusted under 35 U.S.C. 154(b) by 0 days.

(21) Appl. No.: 15/074,196

(22) Filed: Mar. 18, 2016

(65) Prior Publication Data

US 2016/0273233 A1 Sep. 22, 2016

(30) Foreign Application Priority Data

Mar. 20, 2015 (DE) ..... 10 2015 003 664

(51) Int. Cl.
*E04F 15/22* (2006.01)
*E04F 15/02* (2006.01)
(Continued)

(52) U.S. Cl.
CPC ..... *E04F 15/225* (2013.01); *E04F 11/002* (2013.01); *E04F 13/072* (2013.01); *E04F 13/0885* (2013.01); *E04F 13/0889* (2013.01); *E04F 15/02044* (2013.01); *E04F 15/02155* (2013.01); *E04F 15/02194* (2013.01); *E04F 2201/095* (2013.01)

(58) Field of Classification Search
CPC ... E04F 15/02; E04F 13/072; E04F 15/02044; E04F 15/02133; E04F 13/0889; E04F 11/002; E04F 13/0885; E04F 15/02194; E04F 2201/095
USPC ..... 52/403.1, 578, 582.1, 588.1
See application file for complete search history.

(56) References Cited

U.S. PATENT DOCUMENTS 5,118,547 A * 6/1992 Chen ..... E01C 5/20 404/41
5,509,244 A * 4/1996 Bentzon ..... E01C 5/005 428/44
(Continued)

FOREIGN PATENT DOCUMENTS

DE 202 14 264 U1 1/2003
WO WO 2006/027029 A1 3/2006
(Continued)

OTHER PUBLICATIONS

European Patent Office EESR dated Jul. 21, 2016 for Application No. EP 16160985.4, 16 pages.

*Primary Examiner* — Brian E Glessner
*Assistant Examiner* — Adam G Barlow
(74) *Attorney, Agent, or Firm* — Lewis Roca Rothgerber Christie LLP

(57) ABSTRACT

A substrate installation unit for installing with other substrate installation units, in particular of the same type, for covering a substrate, wherein the substrate installation unit comprises a substrate-side attachment structure, which is designed for attaching to the substrate; and a plug connection structure, facing away from the substrate, for releasably plug connecting, in particular with a formation of a snap-in plug connection with a correspondingly designed plug connection structure of a surface installation unit, which comprises a utilization structure.

14 Claims, 11 Drawing Sheets

(51) Int. Cl.

| | |
|---|---|
| ***E04F 11/00*** | (2006.01) |
| ***E04F 13/072*** | (2006.01) |
| ***E04F 13/08*** | (2006.01) |

(56) References Cited

U.S. PATENT DOCUMENTS 5,671,575 A * 9/1997 Wu ..... E04F 15/022 52/403.1
5,806,270 A * 9/1998 Solano ..... E04F 15/02 52/181
7,171,790 B2 * 2/2007 Mei ..... E04F 15/04 52/578
8,276,343 B2 * 10/2012 Yang ..... E04F 15/02 52/509
9,790,691 B2 * 10/2017 Moller, Jr. ..... E04F 15/225
2004/0020153 A1 * 2/2004 Huang ..... E04F 15/02033 52/582.1
2006/0125153 A1 * 6/2006 Moller, Jr. ..... B29C 45/14008 264/453
2009/0031658 A1 * 2/2009 Moller, Jr. ..... E01C 5/20 52/403.1
2010/0313510 A1 * 12/2010 Tang ..... E04F 15/02005 52/403.1
2013/0291474 A1 * 11/2013 Tillery ..... E04F 15/02 52/588.1
2014/0260041 A1 9/2014 Peck et al.
2015/0047286 A1 * 2/2015 Bernat ..... E04F 15/02044 52/588.1
2015/0059271 A1 * 3/2015 Tsai ..... E04F 15/02194 52/302.1
2015/0075092 A1 * 3/2015 Moller, Jr. ..... E04F 15/225 52/177
2016/0273233 A1 * 9/2016 Pekovsek ..... E04F 15/02194
2016/0375296 A1 * 12/2016 Downey ..... A63B 21/4037 52/506.01
2017/0051515 A1 * 2/2017 Aquilani ..... E04F 13/0835

FOREIGN PATENT DOCUMENTS

WO WO 2012/156192 A1 11/2012
WO WO 2006027029 * 3/2016

* cited by examiner

CHANGEOVER COVER WITH PLUG CONNECTION

CROSS-REFERENCE TO RELATED APPLICATION

This application claims priority to and the benefit of the filing date of German Patent Application No. 10 2015 003 664.5 filed 20 Mar. 2015, the entire disclosure of which is hereby incorporated by reference.

TECHNICAL FIELD

Embodiments of the invention relate to a substrate installation unit, a surface installation unit, a functional structure installation unit, a changeover cover, and a method for covering a substrate with a changeover cover.

TECHNOLOGICAL BACKGROUND

Parquet and other conventional panels are relatively time-consuming and expensive to install as floor or wall covers. Also the renovation, or replacement, of such floor or wall covers requires high expenditure in terms of time and cost.

WO 2012/156192 discloses a surface installation unit for installing with other surface installation units at a substrate, wherein the surface installation unit comprises a utilization layer and a connecting structure applied directly at a lower face of a utilization layer, which is configured for connecting with the substrate.

SUMMARY OF THE INVENTION

There may be a need to enable a process of assembly of substrate covers in a resource saving manner, in an environmentally friendly manner, in a flexible manner, with a low expenditure of time and cost, and at the same time in a reliable manner and protected from undesirable high internal stresses.

This need may be met by means of the subject matter with the features in accordance with the independent patent claims.

In accordance with an example of embodiment of the present invention there is provided a substrate installation unit for installing with other substrate installation units, in particular of the same type, for covering a substrate, wherein the substrate installation unit comprises a substrate-side attachment structure, which is designed for attaching to the substrate, and a plug connection structure, facing away from the substrate, for releasably plug connecting, in particular with the formation of a snap-in plug connection, with a correspondingly designed plug connection structure of a surface installation unit, which comprises a utilization structure.

In accordance with yet another exemplary example of embodiment of the invention a surface installation unit is provided for installing with other surface installation units, in particular of the same type, on substrate installation units, in particular on substrate installation units with the above-described features, for forming a changeover cover, wherein the surface installation unit comprises a utilization structure for forming an exposed outer surface of the changeover cover, and a plug connection structure facing away from the utilization structure for releasably plug connecting, in particular with the formation of a snap-in plug connection, with a correspondingly designed plug connection structure of the substrate installation units, which comprise a substrate-side attachment structure.

In accordance with a further example of embodiment of the present invention there is provided a functional structure installation unit for arranging between a substrate installation unit, in particular with the above-described features, and a surface installation unit, in particular with the above-described features, wherein the functional structure installation unit comprises an upper-side plug connection structure, which is designed for forming an upper-side releasable plug connection, in particular with the formation of a snap-in plug connection, with a corresponding plug connection structure of the surface installation unit, a lower-side plug connection structure, which is designed for forming a lower-side releasable plug connection, in particular with the formation of a snap-in plug connection, with a corresponding plug connection structure of the substrate installation unit, and a functional structure for providing an ancillary function in a changeover cover, which is formed from the substrate installation unit being attached to the substrate, the surface installation unit being exposed at an exposed upper face of the changeover cover, and the functional structure being arranged in between.

In accordance with a further example of embodiment of the present invention there is provided a changeover cover for covering a substrate, wherein the changeover cover comprises a number of substrate installation units with the above-described features, which together are designed for an, in particular essentially gap-free, covering of the substrate, and a number of surface installation units with the above-described features, which are designed for an, in particular essentially gap-free, covering of the substrate installation units covering the substrate, wherein the plug connection structures of the substrate installation units and the plug connection structures of the surface installation units are matched to one another such that they can be brought into a plug-in engagement with one another with the formation of a releasable plug-in connection, in particular with the formation a snap-in plug connection.

In accordance with a further example of embodiment of the present invention there is provided a method for covering a substrate with a changeover cover, wherein in the method attachment structures of a number of substrate installation units are attached to the substrate, such that plug connection structures are exposed at an exposed surface of the installed substrate installation units, and releasable plug connections, in particular with the formation of a snap-in plug connection, are formed between the plug connection structures of the substrate installation units and correspondingly designed plug connection structures of a number of surface installation units, such that at an exposed surface of the changeover cover formed from the substrate installation units and the surface installation units, an, in particular essentially gap-free, arrangement is formed from utilization structures of the surface installation units.

In the context of this description a "surface installation unit" can be understood as to mean in particular a substrate cover module, the utilization layer of which, in the installed state, on or above a substrate, is exposed, i.e. visible, in the outward direction (if required, in addition covered with an optional protective coating, etc.). The installation of the surface installation unit can, for example, take place by means of a plug connection structure at the lower face of the surface installation unit and by means of a related plug connection structure at the upper face of the substrate installation unit that is connected with the surface installation unit. Alternatively, it is also possible to connect the surface installation unit directly with a substrate, in particular with a building substrate, for example proximately, (that is to say, without any other components in between) on the substrate installation unit. The term "surface installation unit" is to be understood as to mean that the latter can be installed on any flat substrate, for example, a horizontal surface (in particular a floor, stair, or ceiling surface), an inclined surface (in particular a ramp), or a vertical surface (in particular a wall surface). The utilization layer or the surface installation unit can also be installed directly on a flat surface.

In the context of this description a "substrate installation unit", in particular a substrate cover module, can be understood as to mean that connection can be made directly with a substrate, in particular with a building substrate, for example, it can be installed proximately (that is to say, without any other components in between) on the substrate. This installation can take place, for example, by means of an attachment structure at the lower face of the substrate installation unit. Installation can take place at the floor, on stairs, on ceilings, or on walls.

In the context of this description a "substrate" can be understood as to mean in particular any (for example flat) surface that can be covered with a cover. The substrate can be a substrate of a building (for example, a building floor, a building ceiling, or a building wall), i.e. an on-site substrate. However, it is also possible to deploy a staircase or a staircase (in particular horizontal and/or vertical surfaces of steps) as a substrate, on which surface installation units and/or substrate installation units in accordance with embodiments of the invention with any of the configurations described in the context of this application can then be installed. The substrate for a surface installation unit can, however, also be a substrate installation unit if optionally, but advantageously, a substrate installation unit is to be arranged in between an on-site substrate and a surface installation unit. Thus many different possible combinations exist for the installing the surface installation units directly, or with substrate installation units. The provision of an optional, but advantageous, substrate installation unit with the additional provision of a similarly optional, but advantageous, combinable functional layer, reveals particularly positive consequences.

In the context of this description a "utilization structure" can be understood as to mean in particular a surface layer, on which the actual mechanical and/or chemical and/or thermal loading takes place on the installed floor or wall cover. Also the utilization structure is that which, in the installed state, visibly shapes the design, i.e. the visual appearance, of the cover for the user. In the case of parquet flooring this is the layer that a user uses as flooring so as to walk on the latter. In the case of stair covers this is the layer that defines the step surfaces.

In the context of this description an "upper face" of a layer or an element can be understood as to mean in particular a primary surface of this layer or this element, which with correct installation of this layer or this element is facing away from the substrate. Correspondingly, a "lower face" of a layer or an element can be understood as to mean in particular a primary surface of this layer or this element, which with correct installation of this layer or this element is facing towards the substrate.

In the context of this description a "releasable plug connection" of two elements by means of two plug connection structures can in particular be understood as to mean that after the formation of such a form-fit connection the latter can be released once again reversibly, and without incurring any damage, by the application of a release force. By means of such a release without any damage the two interacting plug connection structures can be reused after the release, in particular, they can be reused at least ten times, without the connection function thereby being adversely affected or impaired. The release of such a connection can be executed by a user without the deployment of a tool. For such a release the application of a release force of less than 100 N can be sufficient. In order to prevent any inadvertent release of the installed cover, the release force should be more than 20 N. However, the forces can also have other magnitudes.

In accordance with one exemplary example of embodiment of the invention, a changeover cover and its constituents, matched to one another, (substrate installation unit, surface installation unit and, if required, functional structure installation unit) are provided, whereby a simple changeover is enabled, without any tools, and without incurring any damage of the outward appearance of the utilization structure of the surface installation unit. For this purpose it has proved to be extremely advantageous to provide a plug connection structure at an upper face of the installed substrate installation units with a correspondingly designed plug connection structure at a lower face of the surface installation unit, such that a robust plug connection can be formed by simply vertical lowering and plugging on of the surface installation units onto the substrate installation units which have already been installed on a substrate, without any other assembly steps being required. By virtue of the releasability of the plug connection, by means of a simple process of extraction, the surface installation units (for example, because they are worn out or are to be replaced by another desired utilization structure) can be reversibly released from the substrate installation units, without incurring any damage to the changeover cover, in particular to the substrate installation units, and without a costly and time-consuming disassembly being necessary. With embodiments of the present invention it has in particular been discovered that by the formation of the plug connection between the plug surfaces, opposite one another, of the surface installation unit and the substrate installation unit, not only an extraordinarily robust connection is provided, and one that can nevertheless be released without any tools, but also such a plug connection has extremely favorable properties with regard to manufacturability on an industrial scale, and its ability to compensate for thermal stresses, and other mechanical stresses, in the interior of the changeover cover. In this context "ability to compensate" is understood to mean in particular the ability of the changeover cover, in the event of the occurrence of thermal stresses and other mechanical stresses in the interior of the changeover cover, to instigate compensating strains and deformations in an interaction with the stresses occurring. By means of the form-fit engagement of the corresponding plug connection structures of the surface installation unit and the substrate installation unit, a lateral coupling (that is to say, a coupling at the longitudinal faces and/or end faces) of the surface installation units can also be eliminated, which further improves the time and cost of manufacture and assembly without any loss of mechanical robustness.

In what follows additional exemplary examples of embodiment of the substrate installation unit, the surface installation unit, the functional structure installation unit, the changeover cover, and the method are described.

In accordance with an example of embodiment the attachment structure of the substrate installation unit can be an adhesive structure or at least one attachment element to be introduced into the substrate. A double-sided adhesive film, a hot-melt adhesive, etc., can, for example, be used as the adhesive structure so as to fasten the substrate installation units securely and permanently to the substrate. Alternatively, with the use of one or a plurality of attachment elements, such as, for example, screws, nails, or rivets, an anchoring of the substrate installation units onto the substrate can take place.

In accordance with an example of embodiment the attachment structure of the substrate installation unit can be designed as the body essentially covering the substrate over its full surface, in particular as a flat support layer. In the case of a full-surface attachment of the lower face of the substrate installation units at the substrate, any undesirable separation of the substrate installation units, which remain permanently at the substrate, even in the event of a changeover of surface installation units, is eliminated. For this purpose it can be advantageous also to provide the attachment structure as a full-surface body (that is to say, in particular, a continuous layer), so as to make possible a large adhesive surface. It has been turned out, that with an appropriate choice of materials and with a design of such a flat support layer with a sufficiently small thickness, the attachment structure can maintain a certain elasticity and bendability, which also in the event of thermal or other mechanical stresses on the substrate, or within the changeover cover, enables the dissolution of such stresses without the robustness of the plug connections between the individual constituents of the changeover cover thereby being impaired.

In accordance with an example of embodiment the plug connection structure of the substrate installation unit can have a number of plug connection elements, which protrude in a raised manner relative to the attachment structure. In that such plug connection elements protrude upwards relative to the support layer, a form-fit with corresponding plug connection elements of the surface installation units is enabled. As an alternative to the provision of plug connection elements protruding in a raised manner above the support structure, however, in the case of the substrate installation unit the provision of other plug connection elements is also possible, which are provided as grooves, passage holes, or recesses in the attachment structure, which is designed, for example, as a support layer.

In accordance with an example of embodiment the plug connection elements of the substrate installation unit can comprise an, in particular oval, snap-in ring for forming a snap-in plug connection with corresponding leaf spring structures of the plug connection structure of the corresponding surface installation unit. A snap-in body, which is designed as an essentially rigid structure for forming a snap-in plug connection with leaf spring structures at the surface installation unit, allows for a robust plug connection to be formed, which at the same time can easily be released. Such a snap-in plug connection can also take place simply by means of movement of elements of the installation device in a primary surface plane (and not at right angles to the latter) of the substrate installation unit or the surface installation unit, whereby the formation of the snap-in plug connection does not lead to any increase in the build height of the changeover cover. In particular the snap-in body can be designed as a snap-in ring, that is to say, saving material and weight with the formation of an internal hole, or as a solid snap-in body, and therefore particularly robust. Needless to say, in accordance with other exemplary examples of embodiment of the invention other types of snap-in connections are also possible.

In accordance with an example of embodiment the plug connection elements of the substrate installation unit can comprise positioning nubs, which can be configured for engaging, allowing for a compensating movement, in corresponding, in particular oval, guide ring structures of the plug connection structure of the corresponding surface installation unit. The positioning nubs can be designed as point-shaped or pin-shaped protrusions, which engage in grooves or passage holes in the interior of guide ring structures. By this means, if the guide ring structures are designed as elongated holes, it is possible for the positioning nubs, along a predefinable extension direction of such elongated holes, to perform a geometric, i.e. spatial, compensating movement, if dimensional fluctuations occur, for example, as a result of manufacturing tolerances, or mechanical stresses caused by temperature.

In accordance with one preferred exemplary example of embodiment the positioning nubs can align the leaf spring structures with related snap-in elements, such that the snap-in body latches securely independently of any deformation and/or movement within an extension plane of the substrate installation unit. In other words, the positioning nubs can align the leaf spring structures with related snap-in elements, such that the snap-in bodies latch securely independently of any deformation/movement in the surface.

In accordance with an example of embodiment the substrate installation unit can further comprise load-accommodating structures, in particular load-accommodating ribs, which are arranged between the plug connection elements, protrude in a raised manner relative to the attachment structure, and are designed for accommodating mechanical loads acting on the substrate installation unit. In order to protect the plug connection elements from being subjected to the action of excessive forces when forming a plug connection with the corresponding plug connection structure of the surface installation unit, the load-accommodating structures can be formed in exposed surface regions of the substrate installation units, which load-accommodating structures direct any mechanical load acting on faces of the surface installation unit through the load-accommodating structures into the substrate, without appreciably or excessively loading the plug connection elements mechanically. Here the load-accommodating structures are able to accommodate both static loads (for example, a piece of furniture, which permanently stands on a changeover cover designed as a floor cover) and also dynamic loads (for example, the footfall loading of a user who is walking over the changeover cover designed as a floor cover).

In accordance with an example of embodiment of the substrate installation unit, in a first extension direction the snap-in ring can comprise a larger dimension than in a second extension direction that is orthogonal to the first extension direction, wherein along the first extension direction the snap-in ring is arranged between two load-accommodating structures extending along the second extension direction, and wherein along the second extension direction the snap-in ring is arranged between two positioning nubs. Thus, the compensating movement can be enabled in one direction that is at right angles to another direction, along which the load-accommodating structures extends. In this manner, in particular, if plug connection unit cells formed in the described manner are arranged alternately in different directions, an efficient load accommodation can be combined with a robust and at the same time sufficiently flexible plug connection function, and thereby the surface that is available is efficiently utilized.

In accordance with an example of embodiment the plug connection structure of the substrate installation unit is designed with plug connection unit cells, in particular, in a two-dimensional periodically repeating grid, in particular with a grid dimension in a range between 10 mm and 100 mm. In accordance with this particularly preferred configuration a grid structure can be provided with which, on the one hand, an attachment of, for example, otherwise dimensioned, or otherwise installed, surface installation units is enabled, also spanning over substrate installation units. For a user this increases the flexibility in the assembly of a changeover cover that is built up from any modules that can be combined. At the same time such a grid pattern leads to a homogeneous load distribution and to an even provision of a plug connection force arising as a result of shape and friction.

In accordance with an example of embodiment of the substrate installation unit the grid can be formed by an, in particular two-dimensional, alternating sequence of the plug connection unit cells, which extend alternately in a first direction of orientation, and in a second direction of orientation that is orthogonal to the first. In a particularly advantageous manner, in the grid a plug connection unit cell can firstly be oriented in a first direction, and subsequently in another, second direction (for example, one that is orthogonal to the first direction). By this means the occurring loads can be better distributed over the various spatial directions. Also by means of such an alternating sequence of plug connection unit cells with different spatial orientations, an attachment result can be improved by means of plug connection forces acting in various spatial directions.

In accordance with an example of embodiment a particular plug connection unit cell can be formed from an arrangement of a snap-in ring, load-accommodating structures, and positioning nubs with the above-described features. By means of this arrangement a spatial anisotropy of the load introduction properties and/or the compensating movement properties can be achieved in small dimensions; on a large scale, however, the characteristics are spatially isotropic. Clearly both the guide structures, and also the load-accommodating structures, can extend alternately in the longitudinal and transverse directions. Other angles between the alternating extension directions are also possible. Furthermore it is possible that more than two types of plug connection unit cells alternate with different alignments in the alternating arrangement, for example three or four.

In accordance with an example of embodiment the plug connection structure of the substrate installation unit can comprise a number of plug connection elements, which are designed with the features of the plug connection elements that are described below for the surface installation unit. The configurations of the substrate installation unit described so far can, for example, be combined with a flat support panel of the attachment structure, from which the mentioned plug connection elements or load-accommodating structures then rise vertically. Alternatively, the mentioned plug connection elements (in particular snap-in bodies, positioning nubs, etc) or load-accommodating structures (for example, load-accommodating ribs) can be integrated into a frame structure. In the last example of embodiment mentioned a flat support panel or similar can be eliminated under some circumstances. A flat support panel with the above-described plug connection elements (snap-in bodies, positioning nubs) and/or load-accommodating structures (in particular load-accommodating ribs) can also be provided at a flat support panel, or similar, on faces of the surface installation unit, wherein the plug connection elements and/or load-accommodating structures, preferably to be integrated into a frame structure, can be designed as part of the substrate installation unit.

In accordance with an example of embodiment the substrate installation unit and/or the surface installation unit can be designed as a cast structure (in particular a pressure-cast structure or an injection-molded structure), as a milled structure, or as a generatively constructed structure (in particular a 3D printed structure or a laser-sintered structure). The design of the substrate installation unit as a cast structure is particularly preferable so as to enable cost-effective production on an industrial scale. Such a technology for the production of the plug connection is also compatible with materials that with good mechanical robustness also offer elasticity and/or flexibility so as to compensate for any mechanical stresses that occur.

In accordance with an example of embodiment the substrate installation unit and/or the surface installation unit can be designed as one-piece and/or one-material entities. In the case of design of a particular installation device as a one-piece entity production with a low level of cost and time is possible, since the design of connections between individual components of the installation device can be eliminated. The use of one material for the installation device has, in addition to a simple manufacturability, the advantage that boundaries between materials, and the undesirable effects connected with these (for example, different thermal expansion coefficients, which can lead to the formation of mechanical stresses in operation) can be avoided.

In accordance with an example of embodiment the substrate installation unit and/or the surface installation unit can comprise plastics, metals and/or wood-plastic composite materials, or can consist of these. Polymer materials (i.e. materials of synthetic plastic and/or of modified natural polymers), metals (such as aluminum) and wood-plastic composite materials in each case combine cost-effective manufacturability with a high level of mechanical robustness and good elasticity.

In accordance with an example of embodiment the substrate installation unit and/or the surface installation unit in each case can have a vertical thickness in a range between 0.5 mm and 10 mm, in particular between 1 mm and 3 mm. Thus the desired robustness properties can be provided with an extremely low build height, and therefore compact and saving on materials.

In accordance with an example of embodiment, the substrate installation unit can comprise a lateral coupling structure, in particular at least one dovetail structure, which can be provided in at least one edge region of the substrate installation unit, and which can be designed for coupling with a corresponding lateral coupling structure of another substrate installation unit, in particular one of the same type. It has proved to be particularly advantageous to have a five-off fixing pattern, in particular two-off in the x-direction, one-off in the y-direction and two-off in the z-direction. Here, x and y denote directions that are orthogonal to one another in an installation plane, and z denotes a direction that is orthogonal to x and y, and at right angles to the installation plane. Such a fixing can be designed, for example, in the form of a hook. By means of lateral connection of the substrate installation units, for example on an end face and/or on a longitudinal face, even in the event of a failure of the attachment structure at the surface of the substrate installation units facing the substrate, a connection of the substrate installation units with one another can be maintained. A lack of geometric functional installation of the substrate installation units can advantageously be made mechanically impossible by means of coupling structures provided at appropriate positions.

In accordance with an example of embodiment the attachment structure of the substrate installation unit can be designed so as to attach the substrate installation unit to the substrate in a point-form, line-form, or full-surface manner. Full-surface bonding with adhesive provides a particularly good and reliable attachment. Bonding at a series of points allows for a particularly high level of flexibility, elasticity and compensating movement capability. Bonding, or attachment on a series of lines provides a compromise between the two limiting cases described.

In accordance with an example of embodiment the substrate installation unit can comprise a functional structure (i.e. a structure, which integrates an additional function into the changeover cover) between the plug connection structure and the attachment structure. Thus it is advantageously possible to provide a desired ancillary function of the changeover cover on the substrate installation side. In the event of a changeover of the surface installation units (for example, if the utilization structure has been worn out, or in order to provide another utilization structure) a changeover of the functional structure can therefore be omitted. This saves on resources and reduces the cost and time of installation, even in a scenario in which an ancillary function is desired. A functional layer can advantageously be fitted with plug connections aligned downwards and upwards and matched to substrate and surfaces.

In accordance with an example of embodiment the functional structure can be designed as a heating device (for heating the changeover cover), a cooling device (for cooling the changeover cover), a noise attenuation device (for attenuating footfall noise), a sensor device (for example, for detecting a user walking on the changeover cover, for example, in the context of an alarm system), an actuator device and/or a mechanical strengthening device (for increasing the robustness of the changeover cover). However, other functional structures are also possible, for example, generative and/or recuperative elements.

In accordance with an example of embodiment the utilization structure of the surface installation unit can be selected from a group that consists of a layer comprising wood, a layer consisting of wood, a stone layer, a ceramic layer, a carpet, a tiled layer, and a plastic layer. Thus, in accordance with a first form of embodiment the utilization structure is inflexible and/or rigid (as in the case of wood, stone, tiling, etc.), and in another form of embodiment is compliant or elastic (as, for example, in the case of carpet or certain plastics). It has been proved that the design of plug connections is compatible with all these utilization structures. Also cork, material, woven fabric, metal panels, artificial grass, and glass are possible materials for the utilization structure in accordance with exemplary examples of embodiment of the invention. Hybrid solutions with a plurality of materials and/or combinations of a plurality of the materials cited and others are also possible.

In accordance with an example of embodiment the utilization structure can have a thickness in a range between 0.5 mm and 4 mm. In the case of smooth and/or solid covers (in particular wood, soft covers, ceramics) the utilization structure can have a thickness in a range between 0.5 mm and 2 mm. In the case of carpets, on the other hand, the utilization structure can have a thickness of up to 4 mm. The thickness of the utilization structure can be designed to be advantageously very much less than that in the case of conventional substrate covers, since in the event of wear of the utilization structure the surface installation unit can simply be exchanged for another surface installation unit without the need for significant cost and time in assembly. This leads to a saving in resources and is possible with significantly less labor than is the case, for example, with the conventional changeover of parquet and/or other floor covers.

In accordance with an example of embodiment the plug connection structure of the surface installation unit can be attachable, or can be attached, to the utilization structure by means of an attachment structure, in particular by means of an adhesive structure and/or at least one attachment element to be introduced into the utilization structure. Double-sided adhesive tape, or a hot-melt adhesive, can, for example, be used as the adhesive. The attachment of the utilization structure to the plug connection structure by means of attachment elements such as screws, nails and/or rivets is also possible.

In accordance with an example of embodiment the attachment structure of the surface installation unit can be designed so as to attach the substrate installation unit to the substrate in a point-form, line-form, or full-surface manner, in particular, whilst maintaining a compensating movement capability, in particular one that furthermore is elastic, for the plug connection structure. In the case of a full-surface connection a particularly good attachment result can be achieved. However, what is preferred is an only partial connection of one of the opposing surfaces of attachment structure and utilization structure, as it is the case with a point-form or line-form attachment. Such an attachment, for example, along only certain sections of a frame structure of the plug connection structure of the surface installation unit, maintains a mechanical compensating movement capability and allows the utilization and plug connection structures (usually manufactured from different materials) to execute a compensating movement in the event of stresses caused by temperature. The measure is also advantageous for compensating for tolerances caused in manufacture.

In accordance with an example of embodiment the plug connection structure of the surface installation unit can be designed as a frame structure, consisting of strips, in particular elastic strips, connected together, with a number of plug connection elements integrated therein. The design of the plug connection structure from strip-type frame elements leads to a lightweight surface installation unit that saves on resources, which nevertheless has a sufficient mechanical strength to form a reliable plug connection with the substrate installation unit.

In accordance with an example of embodiment the plug connection elements of the surface installation unit can comprise (in particular two opposing one another) leaf spring structures, which are configured for forming a snap-in plug connection with an (in particular oval) snap-in ring of the plug connection structure of the corresponding substrate installation unit. The leaf spring structures can in particular be formed from two strips of the frame structure opposing one another, which spring outwards with the introduction of the snap-in body of the substrate installation unit between the two leaf spring structures, and thereby generate a clamping force holding the snap-in body in engagement. For ease of introduction of the snap-in body into the material-free region between the opposing leaf spring structures, the snap-in body and/or the leaf spring structures can be provided with appropriate entry chamfers, which accomplish the introduction intuitively and with less force. These entry chamfers can also limit the displacement movement of the leaf spring structures when forming the snap-in connection or plug connection onto the primary plane of the formed changeover cover, so that the plug connection advantageously does not lead to any increase in the build height.

In accordance with an example of embodiment the plug connection elements of the surface installation unit can comprise (in particular oval) guide ring structures, which are configured for accommodating, enabling a compensating movement, corresponding positioning nubs of the plug connection structure of the corresponding substrate installation unit. The guide ring structures can be formed in terms of a boundary strip, closed on its periphery, in the interior of which a straight or curved guide can be formed for the positioning nubs. Such a guide structure, preferably allows the movement of the positioning nubs in a respective preferential direction.

In accordance with an example of embodiment of the surface installation unit the leaf spring structures can be designed to provide a spring function in a spring direction that is arranged orthogonal to a compensating movement direction of the guide ring structures. This immobilizes the changeover cover in a working direction of the leaf springs and allows a compensating movement at right angles to the latter.

In accordance with an example of embodiment the plug connection structure of the surface installation unit can be designed with an, in particular, two-dimensional periodically repeating grid of plug connection unit cells, in particular with a grid dimension in a range between 10 mm and 100 mm. The grid patternation can particularly advantageously serve to provide an ability to install surface installation units and substrate installation units of differing dimensions in a flexible manner, or with edge faces that are not perfectly aligned with one another. By this means a modular system can be provided with a universal ability to combine surface installation units and substrate installation units.

In accordance with an example of embodiment of the substrate installation unit the grid can be formed by an, in particular two-dimensional, alternating sequence of the plug connection unit cells, which extend alternately in a first direction of orientation, and in a second direction of orientation that is orthogonal to the first direction of orientation.

In accordance with an example of embodiment of the surface installation unit a respective plug connection unit cell can be formed by means of an arrangement of leaf spring structures and guide ring structures with the above-described features. As has already been described above for the substrate installation units, the alternating arrangement of the plug connection unit cells leads to an altogether more even load distribution and plug connection force. As already addressed above, the configurations with a flat support panel and/or with plug connection elements such as plug bodies or positioning nubs and/or related load-accommodating structures (in particular load accommodation nubs) can also be implemented in the attachment structure of the surface installation units.

However, it should be noted that a flat support panel with plug connection elements, protruding in a raised manner, and/or load-accommodating structures, can preferably be provided at the substrate installation unit, while a frame structure is preferably provided at the surface installation unit This is for the following reason: The provision of a closed support layer simplifies the immobilization of the lower face of the substrate installation units at the substrate. At the same time the frame-type provision of the plug connection structure at the utilization structure of the surface installation unit allows for a particularly effective compensating movement between these two components to be enabled. The material-saving provision of the frame-type plug connection structure on the surface installation unit, which can be designed as an expendable part or a changeover component, particularly saves on resources.

In accordance with an alternative example of embodiment the plug connection structure of the surface installation unit can have a number of plug connection elements, which are designed with the features of the plug connection elements of the substrate installation unit with the above-described features.

In accordance with an example of embodiment the surface installation unit can comprise a functional structure, which can be integrated into the utilization structure, in particular can be designed as a wear protection layer. For example such a wear protection layer can be applied at an outer-side surface of the changeover cover, for example designed as a paint layer or a sealing layer.

In accordance with an preferred example of embodiment the utilization structure can comprise a plug connection structure-side support structure (in particular a support structure connected with the plug connection structure of the surface installation unit), and can have an (in particular exposed) utilization coating applied onto the outer face of the support structure. For example, the support structure can have a thickness in a range between 1 mm and 3 mm (often less than 2 mm) and can be designed as a support layer. This support layer can serve the purpose that a coating is applied onto it (for example, is deposited or bonded onto it). The support structure can, for example, be designed from a fiber composite material, such as, for example, a cement-bonded glass fiber panel. This has the following advantages: On the one hand such a fiber composite material is sufficiently robust in order to stabilize, for example, a thin wood veneer (for example, with a thickness in a range between 0.5 and 1.5 mm) as a utilization coating. On the other hand fiber composite material coated with ceramic material (for example, with a thickness in a range between 0.5 and 3 mm) has proved to be suitable as a utilization coating. Fibre composite material (in particular a cement-bonded glass fiber structure) is in particular sufficiently temperature-stable to withstand the high temperatures that occur during the ceramic coating process. By implementation of the concept of a support structure and a utilization coating surface installation units in accordance with embodiments of the invention can advantageously also be customized for ceramic surfaces. In particular the utilization structure should convey the visual appearance, and the design of the particular type of cover. For this purpose low thicknesses are accordingly advantageous. In accordance with a further development of embodiments of the invention a universal support panel is provided (can be deployed for a very wide variety of materials), which can be positioned to form the utilization structure between the utilization layer and the plug connection structure. This support panel offers, on the one hand, the advantage of offering a stabilization support (in particular for wood), and, on the other hand, of offering a substrate on which mechanically sensitive covers (in particular a ceramic coating), can be applied.

In accordance with an example of embodiment the changeover cover can furthermore comprise a number of functional structure installation units with the above-described features, for vertically arranging between the number of substrate installation units and the number of surface installation units, with the formation of plug connections on the two surfaces, opposing one another, of the functional structure installation units. Thus, in the changeover cover, either a direct connection can be performed between the plug connection structure of the substrate installation units and the plug connection structure of the surface installation units, or a sandwich-type arrangement of functional structure installation units can be performed between substrate installation units and surface installation units. With the substrate installation units, the surface installation units, and the functional structure installation units, a modular building block system is thus provided, from which a user can assemble a desired combination of functional elements and utilization structure elements.

In accordance with an exemplary example of embodiment the design of a plurality of functional structures, i.e. functional structure installation units, one above another, is also possible.

In accordance with an example of embodiment the plug connection structures of the surface installation units and the plug connection structures of the substrate installation units are matched to one another such that with the formation of a releasable plug connection a snap-in process takes place between the plug connection structures, in particular exclusively in a plane that is arranged parallel to the utilization structure. By this means the design of a robust snap-in connection is enabled without increasing the build height of the changeover cover.

In accordance with an example of embodiment the plug connection structures of the surface installation units can have a higher bending stiffness than the plug connection structures of the substrate installation units. This ensures that, in particular at the substrate side, a compensating movement is enabled in the event of tolerances caused in manufacture or by thermal mismatches. A higher bending stiffness can advantageously be achieved on faces of the surface installation unit by means of a lightweight frame structure, which at the same time saves on resources, whereas a lower bending stiffness can be achieved with a particularly advantageous, comparatively thin, full-surface support layer for the substrate installation unit.

In accordance with an example of embodiment the method can furthermore include a removing of the surface installation units from the substrate installation units, and a subsequent forming of releasable plug connections between the installed substrate installation units and other surface installation units, in particular other surface installation units with another utilization structure. Such a changeover of surface installation units can in particular, be undertaken without any tools and without incurring any damage, for example, if the utilization structure of the surface installation units is worn out, or another utilization structure is desired by a user.

Both the surface installation units and also the substrate installation units can be manufactured in practically any formats. In particular, this includes all four-cornered configurations, furthermore in particular rectangular arrangements. However, other shapes are also possible, such as, for example, other polygons (for example, hexagons).

In accordance with an example of embodiment the corresponding plug connection structures can be configured for connecting with the respectively related substrate installation unit, surface installation unit and/or functional structure installation unit such that they can be released, in particular can be released by using manual muscle power and/or without any tools. By this means it can be made possible for the utilization layer (for example, together with a part of the connecting structure, or together with the whole connecting structure) to be removed and, if required, to be replaced with another, without the provision of a separate tool and without any damaging manipulation.

In accordance with exemplary examples of embodiment it is also possible for special equipment to be deployed for assembly and/or disassembly (for example, heating equipment, radiation equipment, mechanical aids). The deployment of electrical disassembly aids is also possible.

In accordance with an example of embodiment a two-dimensional connection (full-surface, strips, etc.) can be undertaken on the substrate (wall, ceiling, floor, etc.). Thus a two-layer, three-layer, or solid wood parquet installation unit on a substrate (for example, screed, wood floor, tiling, laminate, PVC cover, carpets, etc.) is possible. Here the connection with the other surface can take place over the full surface, or in strips.

In accordance with yet another example of embodiment of the invention a cover layer of solid wood can be applied onto a substrate (for example, screed, wood floor, tiling, laminate, PVC cover, carpets, etc). The accompanying connecting components can, for example, be applied over the full surface of the substrate (screed, wood floor, tiling, laminate, PVC cover, carpet, etc.).

A width connection and face connection between cover layer and cover layer is possible. Such connections can be designed appropriately, both for the case of execution on a substructure manufactured in the factory, and also for the case of connection of the cover layer with the substrate.

The utilization layer can function as the cover layer, and can, for example, be abraded in a one-off process. This can, for example, also be undertaken by means of impulses (current, heat, bi-metal effect, or other). Thus the option of, for example, one-off abrasion of the utilization layer can be combined with the option of the simple changeover of the whole surface installation unit for the further improved utilization of resources.

Instead of the separate provision of a stability layer (solid wood layer) and an accompanying veneer (thin wood layer) these can also be designed in one piece. The utilization layer thickness can be reduced according to a utilization cycle, so that it is possible for the user, for example, to have a new wood floor every five years without the need for a very large installation effort.

European types of wood that can be processed into surface installation units, or substrate insulation units, are oak, beech, sycamore, birch, walnut, cherry, ash, olive, acacia, elm, apple, pear, and Spanish chestnut. Non-European types of wood that for example can be processed into surface installation units, or substrate insulation units, are merbau, wenge, teak, or mahogany.

Timber products, the cross-sections of which have been worked from logs and optionally have been machined further (using drilling, milling, planing processes, etc.) can be designated as solid wood, out of which surface installation units and/or substrate installation units can be fully or partially formed. The structure of the wood is not altered mechanically or mechanically-chemically, other than in the case of laminated timber and wood composites. However, smoking and/or steaming of the material is possible. The bonding of various materials is also possible.

In the case of multi-layer substrate installation units wood composites are also deployed as supports. Wood composites can be materials that are generated by the shredding of wood and subsequent joining together of the structural elements. The size and shape of the wood particles define the type of wood composite and its properties. The wood particles can be connected together with or without bonding agents or mechanical connections.

Parquet, which is formed from surface installation units and/or substrate installation units, can, for example, be designed as solid parquet or multi-layer parquet. Solid parquet can, in particular, be constructed out of solid pieces of wood, which in accordance with embodiments of the invention can be provided with plug connection structures. Solid parquet can be installed in an untreated state and then abraded with a parquet grinder. A surface treatment can subsequently be undertaken using parquet varnish, floor oil, or wax. Multi-layer parquet can be two-layer parquet or three-layer parquet. The visible surface layer of the respectively formative type of wood can, for example, be 0.5 mm to 2 mm, or up to 4 mm thick, and can be adhesively bonded onto one or a plurality of support layers of a cheaper softwood, or onto a support panel of wood composite.

In accordance with an exemplary example of embodiment a changeover cover or substrate cover is provided, which has a changeover cover element (also called a surface installation unit) and a base cover element (also called a substrate installation unit), wherein the one can be plugged onto the other, and both can once again be released from one another by means of a defined force. The base cover element, i.e. the substrate installation unit, is securely connected with the substrate. The changeover cover element, i.e. the surface installation unit, can be releasably plugged onto the latter. Preferably, no floating installation of the base cover element takes place. The installation takes place preferably orthotropically; an inclined installation is not absolutely necessary. The plug grid can be, for example, 10 mm×20 mm. It should be possible to walk on the base cover element.

This enables a plugging onto without tools, wherein the disassembly process can take place with or without tools. The plug connection (or also parts thereof) should be non-releasably connected with the utilization layer, or with the substructure. The build height of the changeover cover element inclusive of the base cover element can be, for example, between 4 mm and 6 mm. The individual elements of the changeover cover element or the base cover element can have, for example, a width of 200 mm to 600 mm, and a length of 600 mm to 1500 mm.

The ability to position base cover elements and changeover cover elements relative to one another can be achieved, for example, with the use of individual pins, nubs and/or ribs, which protrude and can enter into the counter-element. This allows a simple geometry to be maintained, and can preferably be implemented using entry chamfers. An appropriate grid can be formed with pins, nubs and/or ribs. The stop surface, or stop line can be provided as a separate element at the changeover cover. Furthermore, a guide element can be fitted at the periphery. Positioning can be undertaken in a purely visual manner. It is also possible to deploy a tool as a positioning aid.

For the plugging together process, individual pins, nubs and/or ribs can be provided, which can be arranged in accordance with a grid. Plugging without positioning (for example, in the case of foam) is possible. Two-dimensional plug elements can be used. For example, when jointing a ceramic cover, two-dimensional plug elements can also be deployed. Such joints can be manufactured by means of multi-component injection molding together with the plug connection with the utilization layer. Such joints can safeguard a sealing function. Partial plug elements at the changeover cover elements are possible, for example, around the periphery. The design of an annular plug connection using a bushing and sleeve is also possible. Linear plug elements, sliding elements and/or rotational elements (for example, a bayonet fitting) can also be deployed.

For vertical fixing it is possible to deploy a friction fit, hooks (for example for forming a form-fit connection, in particular with the use of an undercut), or a laterally moved sliding element. Rotational elements (for example, a bayonet fitting), or sprung pins, can also be deployed. It is furthermore possible to provide elastomer elements. An annular snap-in plug connection, a linear snap-in plug connection and/or a bonding agent (for example, an adhesive agent) in a gap are also possible. Furthermore, fixing by means of a reduced pressure is possible (in particular one instigated by movement, for example, using suction pads).

Furthermore, a harmonization of alterations in length in the event of temperature alterations can be enabled. In order to enable an appropriate tolerance compensation a plastic deformation of the connecting elements involved is possible. Elastomer elements (hard and/or soft) can also be deployed. Spring elements, a sliding connection and/or the provision of a grouting compound in the case of ceramic covers is also possible.

For adaptation to climate, tolerance-compensating components in the base cover element and the changeover cover element are possible.

In order to enable disassembly, a lifting-off of the changeover cover element by means of a suction device of lifting equipment, by means of a tie rod (in particular one that can be released), a tie rod (one that can be destroyed), a lifting element (for example, a pull cord) or a manual lifting-off without tools (for example, after slackening off in a previous step of the process) are possible. The injection of air for aiding disassembly is also possible, wherein an air cushion can lift off the element in question.

Load accommodation can take place, such that the load is conducted vertically downward under pressure. The support surfaces should be sufficiently dimensioned for this purpose. It is also possible to enable a continuous direction of force to the substructure by means of a utilization layer system. The horizontal loading can be conducted away by means of thrust forces. Plug elements can be provided that engage with one another. The force transfer can also take place by means of friction.

In the selection of elements for managing the plug connection a positioning relative to one another by means of pins, nubs and/or ribs in the grid can be enabled. A plugging together process (in particular joining) can be managed by means of pins, nubs and/or ribs, which are arranged in the grid. Furthermore a vertical fixing (per element) can be undertaken with a form-fit by means of hooks and undercuts. The lateral fixing (per element) can be undertaken by means of pins, nubs and/or ribs, which can similarly be arranged in the grid. Compensation for production and assembly tolerances can be provided by means of compliant spring elements.

Furthermore, a harmonization of alterations in length in the event of temperature alterations and fluctuations in humidity (the influence of climate) can be enabled by means of compliant spring elements. Release of the changeover cover elements (disassembly) can be undertaken such that the vertical and horizontal loads can be well accommodated.

In accordance with exemplary examples of embodiment of the invention various installation combinations of the surface installation units, substrate installation units and functional structure installation units are possible. In particular, installation in a longitudinal direction, a transverse direction, an inclined direction, etc. is possible.

DETAILED DESCRIPTION OF THE DRAWING

In the following exemplary examples of embodiment of the present invention are described, with reference to the following figures.

In the various Figures the same or similar components are provided with the same reference symbols.

It is to be noted that, for all the Figures and examples of embodiment shown and described, it applies that a first plug connection structure of a surface installation unit and a corresponding second plug connection structure of a substrate installation unit can be interchanged, i.e. that the first plug connection structure can alternatively be provided at the substrate installation unit and the second plug connection structure can alternatively be provided at the surface installation unit.

DETAILED DESCRIPTION OF EXEMPLARY EMBODIMENTS

Figure 1:
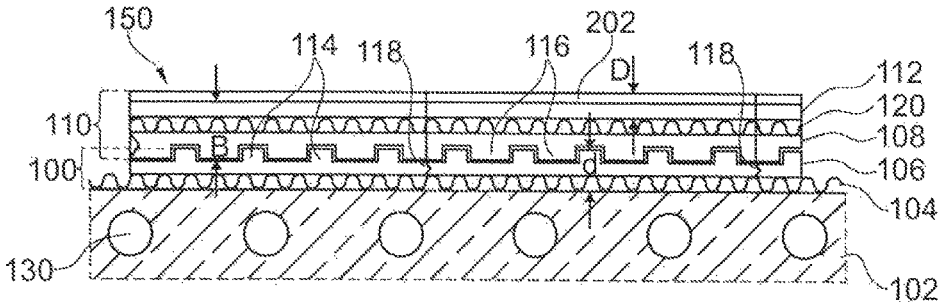
FIG. 1 shows a cross-sectional view of a changeover cover in accordance with an exemplary example of embodiment of the invention.

FIG. 1 shows a cross-sectional view of a changeover cover 150 in accordance with an exemplary example of embodiment of the invention.

The changeover cover 150 serves to overlay, or cover a substrate 102, and is constructed from a number of substrate installation units 100 and a number of surface installation units 110. The substrate installation units 100 form a first cover layer and together cover the substrate 102 in an essentially gap-free manner. The surface installation units 110 form a second cover layer near the surface, and together cover the first cover layer, made up from the substrate installation units 100 cover the substrate 102 in an essentially gap-free manner.

The substrate installation units 100, which among one another are of the same type, comprise in each case a substrate-side attachment structure 104, which is designed for attaching at the substrate 102. Furthermore, each of the substrate installation units 100 comprises a plug connection structure 106 facing away from the substrate 102, for a releasably plug connecting, with the formation of a snap-in plug connection, with a correspondingly designed plug connection structure 108 of a related surface installation unit 110.

Each one of the surface installation units 110, among one another of the same type, has a utilization structure 112 which forms an exposed outer surface of the changeover cover 150. Furthermore, each of the substrate installation units 110 comprises a plug connection structure 108 facing away from the utilization structure 112, for a releasably plug connecting, with the formation of a snap-in plug connection, with one of the corresponding plug connection structures 106 of the related substrate installation unit 100.

The plug connection structures 106 of the substrate installation units 100 and the plug connection structures 108 of the surface installation units 110 are, as shown in FIG. 1, matched to one another (i.e. so dimensioned and shaped) such that they can be brought into a form-fit plug-in engagement with one another with the formation of a snap-in plug connection that can be released by hand. They are located in this state in FIG. 1.

In accordance with FIG. 1 the attachment structure 104 has a full-surface continuous adhesive layer at the lower face of a flat support layer.

The plug connection structure 106 has a number of plug connection elements 114, which protrude relative to the attachment structure 104 in a raised manner, so as to be able to form a form-fit with plug connection elements 116 of the plug connection structure 108.

The substrate installation units 100 can be designed as bodies made of plastic manufactured by means of injection molding in a cost-effective manner, at the lower face of which the adhesive layer can be attached.

A vertical thickness d of the substrate installation units 100 can, for example, be 2.5 mm.

Each of the substrate installation units 100 comprises, at end sections opposing one another, components of a coupling structure 118, which is designed for a form-fit coupling with a corresponding adjacent coupling structure 118 of another substrate installation unit 100 of the same type. By this means substrate installation units 100 that are laterally adjacent to one another can be coupled with one another mechanically. In accordance with an exemplary example of embodiment the coupling structure 118 can only be formed in the substrate installation unit 100, since the surface installation unit 110 is not displaced during the vertical disassembly. Examples for the configuration of the coupling structure 118 can be seen in FIG. 5, FIGS. 15 to 17, FIG. 19, FIG. 20, and FIG. 22.

In each of the surface installation units 110 the utilization structure 112 can comprise solid wood, or can consist of the latter, if a changeover parquet is to be installed as the changeover cover 150. The utilization structure 112, designed as a layer of even thickness, can have a thickness D of, for example, 2 mm. A vertical thickness B of the total surface installation unit 110 can be, for example, 3 mm. The utilization structure 112, designed as a utilization layer, can be designed to be self-stabilizing.

The plug connection structure 108 can be attached at the utilization structure 112 by means of an attachment structure 120, designed, for example, as an adhesive layer. The attachment structure 120 serves the purpose of attaching the plug connection structure 108 at the utilization structure 112 over the full surface. Independently of the attachment the individual components of the surface installation unit 110 should be able to permit an elastic compensating movement of these components relative to one another, for example to compensate for thermal stresses. The attachment structure 120 can act in a manner supportive of stabilization.

Furthermore FIG. 1 shows schematically that an optional floor heating system 130 can be implemented in the substrate 102, which can be formed, for example, from screed.

In addition in accordance with FIG. 1 a functional structure 202 is integrated in the utilization structure 112. This functional structure 202 can be, for example, a paint finish, which protects an exposed surface of the utilization structure 112 from mechanical damage. The functional structure 202 thus serves as a wear protection layer.

The plug connection structure 108, shown only schematically in FIG. 1 and described in more detail below, serves as a support layer with a plug connection capability, and is also self-stabilizing. The plug connection structure 106 serves as a base element with a plug connection capability, and is self-stabilizing. The attachment structure 104 is designed as a connecting layer, and functions as a base element relative to the substrate 102. The substrate 102 can be, for example, a screed, or an existing floor cover.

Figure 2:
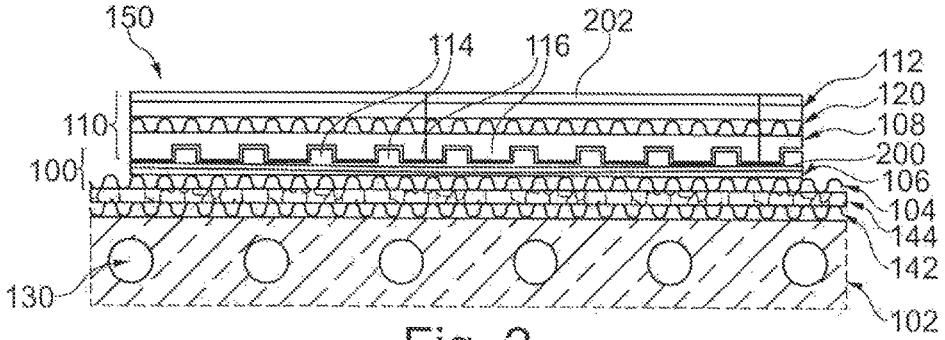
FIG. 2 shows a cross-sectional view of a changeover cover in accordance with another exemplary example of embodiment of the invention.

FIG. 2 shows a cross-sectional view of a changeover cover 150 in accordance with another exemplary example of embodiment of the invention.

In addition to the components of the changeover cover 150 according to FIG. 1, in the case of the changeover cover 150 according to FIG. 2, a further functional structure 200 is arranged between the plug connection structure 106 and the attachment structure 104. The functional structure 200 which is integrated or embedded in the plug connection structure 106 of the substrate installation unit 100, can be, for example, a sensor film. Alternatively, the functional structure 200 can be a floor heating system, a floor cooling system, a footfall sound insulation system, or a mechanical strengthening device.

In addition to the changeover cover 150 according to FIG. 1, in the case of the changeover cover 150 according to FIG. 2, a compensating layer 144 is provided. Furthermore, a connecting layer 142 is provided between the compensating layer 144, and the substrate 102. With reference symbols 142 and 144, a compensating cover is thus implemented between the substrate 102 and the changeover cover 150.

Figure 3:
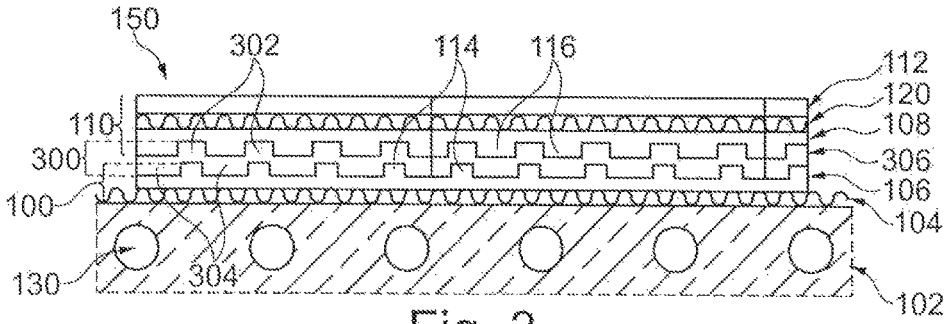
FIG. 3 shows a cross-sectional view of a changeover cover in accordance with yet another exemplary example of embodiment of the invention.

FIG. 3 shows a cross-sectional view of a changeover cover 150 in accordance with yet another exemplary example of embodiment of the invention.

Figure 4:
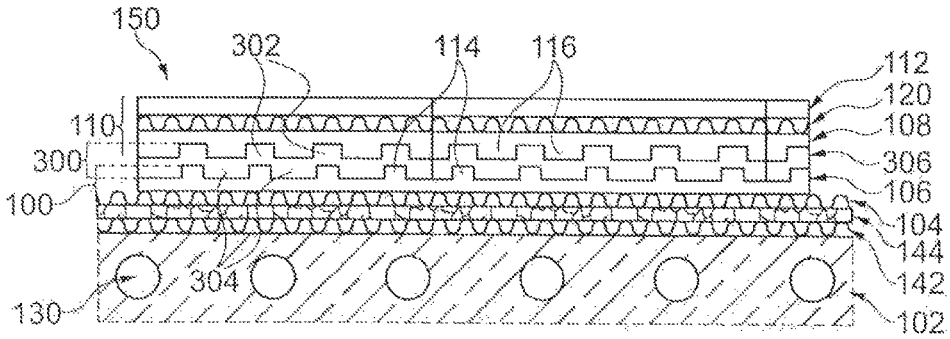
FIG. 4 shows a cross-sectional view of a changeover cover in accordance with a further exemplary example of embodiment of the invention.

The changeover cover 150 according to FIG. 4 contains, in addition to the changeover cover 150 according to FIG. 1, a number of functional structure installation units 300, which are inserted in between a number of substrate installation units 100 and a number of surface installation units 110. This takes place with the formation of plug connections at both surfaces, opposing one another, of the functional structure installation units 300, namely at the upper face with the surface installation units 110, and at the lower face with the substrate installation units 100. For this purpose each of the functional structure installation units 300 contains an upper face plug connection structure 302 to form an upper face releasable snap-in plug connection with a corresponding plug connection structure 108 of the surface installation unit 110, and a lower face plug connection structure 304 to form a lower face releasable snap-in plug connection with a corresponding plug connection structure 106 of the substrate installation unit 100. A functional structure 306 serves to provide an ancillary function in the changeover cover 150, for example, a footfall sound insulation system.

The changeover cover in accordance with FIG. 3 differs from the changeover cover 150 according to FIG. 1 by the additional provision of a functional cover in the form of the functional structure 302. This can selectively be installed in between the substrate installation unit 100 and the surface installation unit 110, or optionally can also be permanently connected (for example, bonded with adhesive) with one of the substrate installation units 100 or the surface installation units 110.

FIG. 4 shows a cross-sectional view of a changeover cover 150 in accordance with a further exemplary example of embodiment of the invention.

The changeover cover 150 in accordance with FIG. 4 differs from that according to FIG. 3 by the additional provision of a compensating cover 142, 144, compare FIG. 2.

Figure 5:
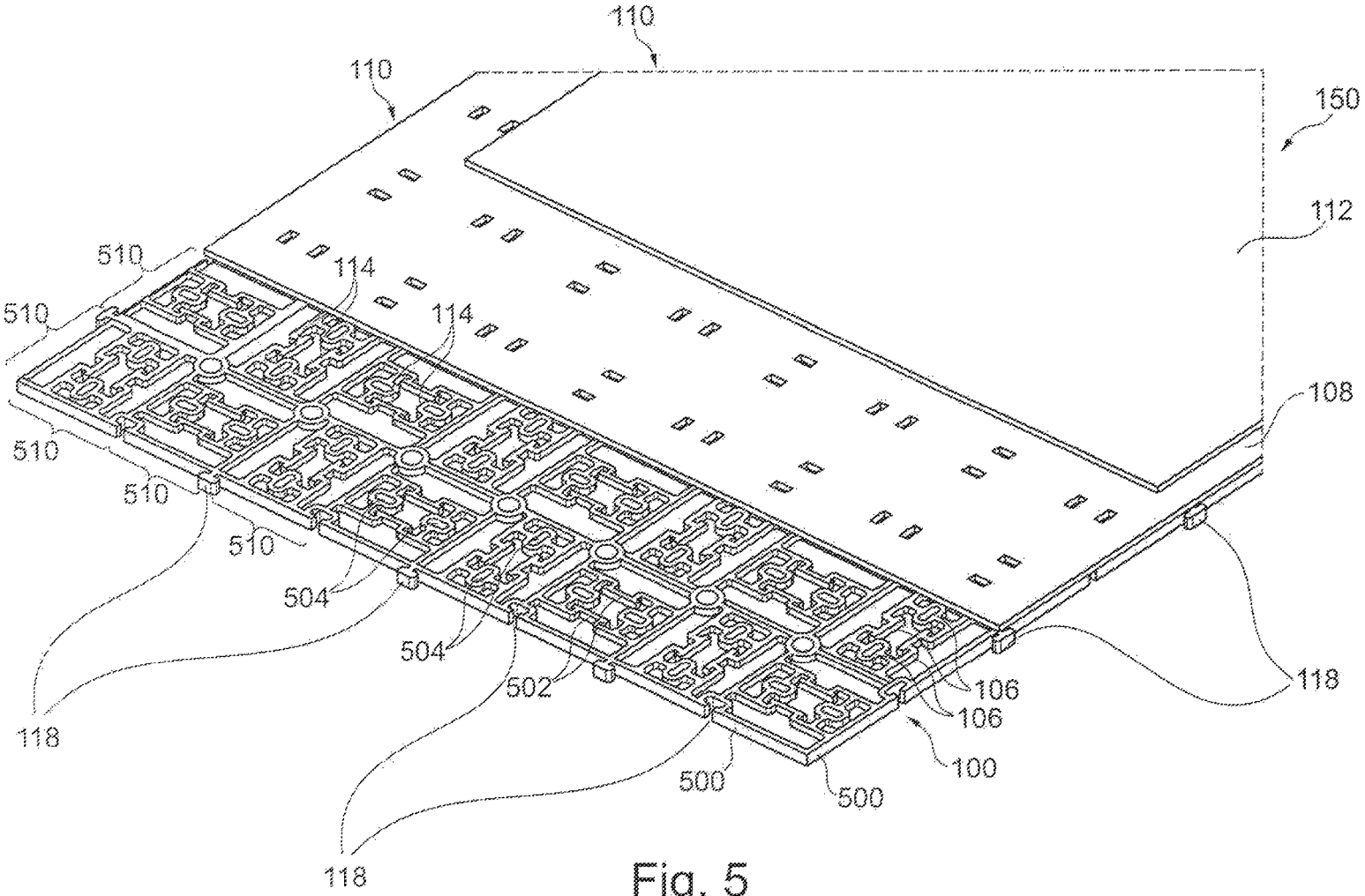
FIG. 5 shows a 3D view of components of a changeover cover in accordance with one exemplary example of embodiment of the invention.
Figure 7:
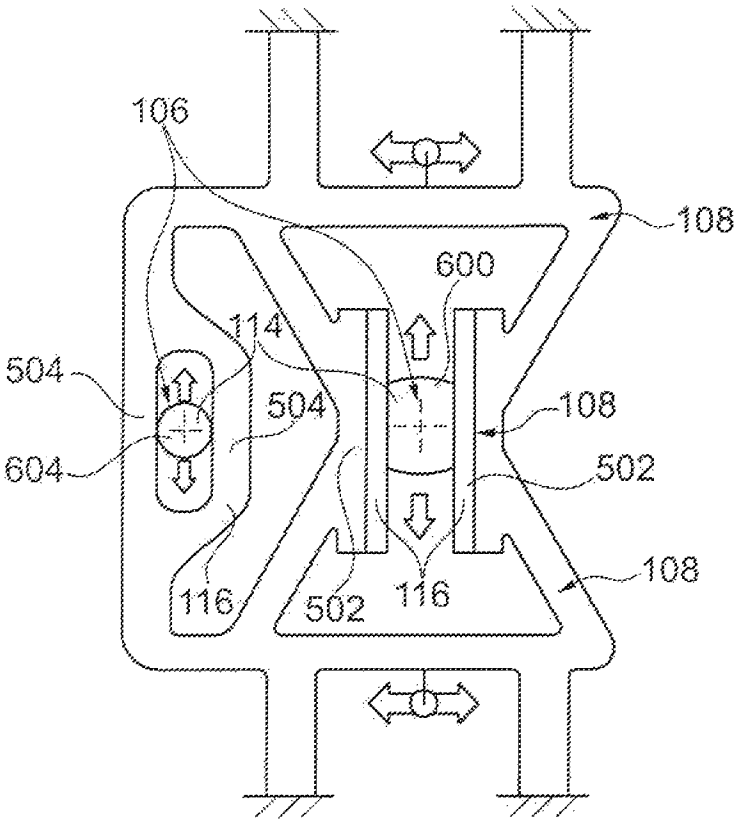
FIGS. 6 to 9 show interacting plug connection structures of surface installation units and substrate installation units of changeover covers in accordance with exemplary examples of embodiment of the invention.

FIG. 5 shows a 3D view of components of a changeover cover 150 in accordance with an exemplary example of embodiment of the invention.

In accordance with FIG. 5 the plug connection structure 106 of the substrate installation unit 100 is designed as a frame structure 500 consisting of elastic strips connected with one another, with a number of plug connection elements 114 integrated therein. Longitudinal and transverse spring elements are also integrated into the frame structure 500, wherein the corner regions of the frame structure 500 lend mechanical stability. The plug connection elements 114 comprise two leaf spring structures 502 opposing one another, which are configured for forming a snap-in plug connection with an oval snap-in body 600 (see FIG. 6) of the plug connection structure 108 of the corresponding surface installation unit 100. The plug connection elements 114 in addition have oval guide ring structures 504, which are configured for accommodating, enabling compensating movement, corresponding positioning nubs 604 of the plug connection structure 108 of the corresponding surface installation unit 100 (see FIG. 6). The leaf spring structures 502 are designed so as to provide a spring function in a spring direction, which is arranged so as to be orthogonal to a compensating movement direction of the guide ring structures 504.

The plug connection structure 106 is designed (as is the plug connection structure 108, not discernible in detail in FIG. 5) as a two-dimensional periodically repeating grid (i.e. in the longitudinal and transverse directions) of plug connection unit cells 510. The grid is formed by an alternating sequence of the plug connection unit cells 510, which extend alternately in a first direction of orientation (leaf spring structures 502 left-right), and in a second direction of orientation (leaf spring structures 502 above-below) that is orthogonal to the first direction of orientation. A particular plug connection unit cell 510 is in each case formed by an arrangement of two leaf spring structures 502 opposing one another and two guide ring structures 504 opposing one another.

Although in accordance with FIG. 5 the plug connection structure 108 of the surface installation unit 110 is designed as a flat support panel with the plug connection elements (not shown in FIG. 5) protruding from the latter in a raised manner, together with the plug connection structure 106 of the substrate installation unit 110, as a frame structure, in another example of embodiment the plug connection structures 106 and 108 can also be changed over, that is to say, the flat support panel with plug connection elements protruding in a raised manner is provided as part of the substrate installation unit 100, and the frame-type plug connection structure 106 is provided as part of the surface installation unit 110.

FIGS. 6 to 9 show interacting plug connection structures 108 of surface installation units 110 and plug connection structures 106 of substrate installation units 100 of changeover covers 150 in accordance with exemplary examples of embodiment of the invention. Here, in accordance with FIGS. 6 to 9, in contrast to FIG. 5, the frame-type arrangement of the plug connection structure 108 of the surface installation unit 110 and the panel-type arrangement of the plug connection structure 106 form the substrate installation units 100.

In accordance with FIGS. 6 to 9 the plug connection structures 108 of the surface installation units 110 and the plug connection structures 106 of the substrate installation units 100 are matched to one another such that with the formation of a releasable plug connection a snap-in process takes place between the plug connection structures 106, 108, and in particular exclusively in a plane that is arranged parallel to the utilization structure 112. The plug connection elements 114 of the substrate installation unit 100 have a snap-in body 600 for forming a snap-in plug connection with corresponding leaf spring structures 502 of the plug connection structure 108 of the corresponding surface installation unit 110. The plug connection elements 114 of the substrate installation units 100 comprise positioning nubs 604, which are configured for engagement, enabling compensating movement, in corresponding guide ring structures 504 of the plug connection structure 108 of the corresponding surface installation unit 110. As can be discerned in FIGS. 6 to 9, the snap-in body 600 in a first extension direction has a larger dimension than in a second extension direction that is orthogonal to the first extension direction, i.e. it is arranged asymmetrically. In accordance with FIG. 9 the snap-in body 600 is arranged between two positioning nubs 604.

Figure 6:
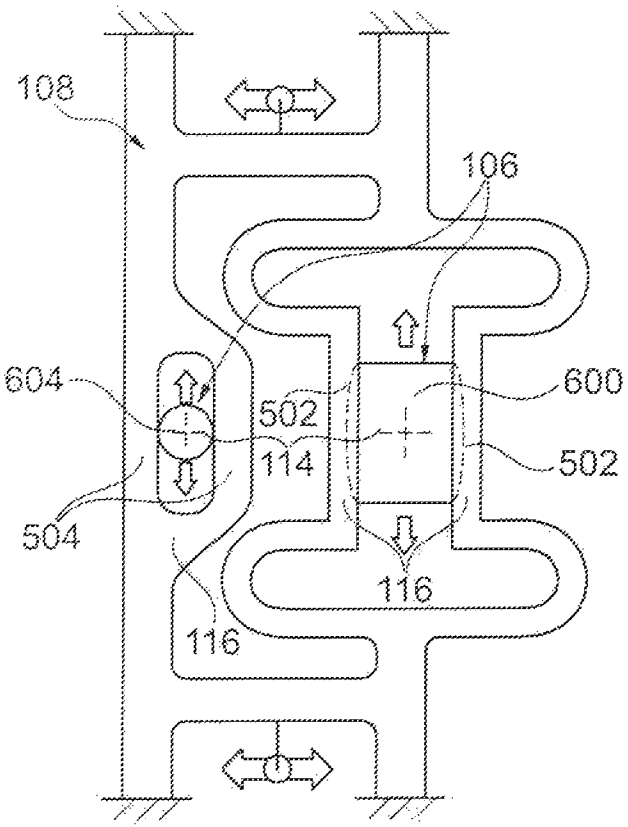
Figure 9:
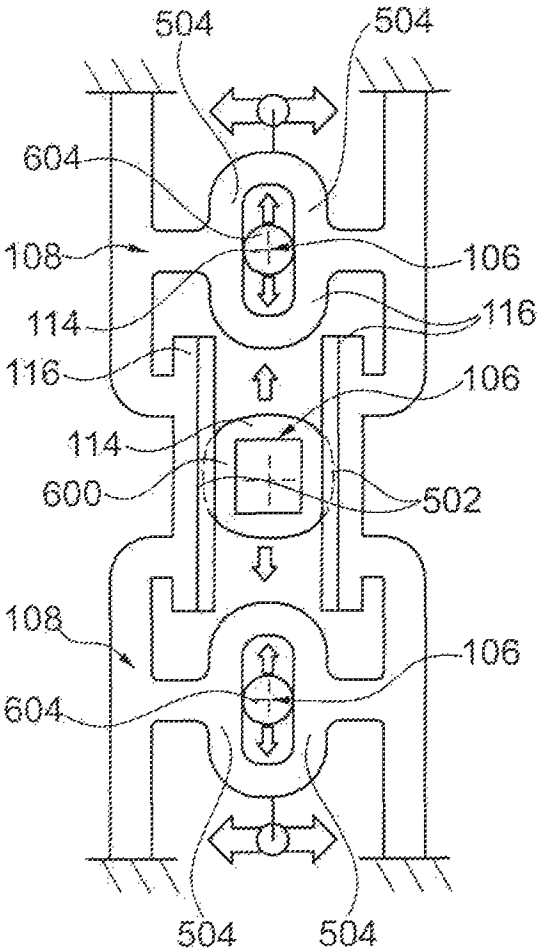
Figure 8:
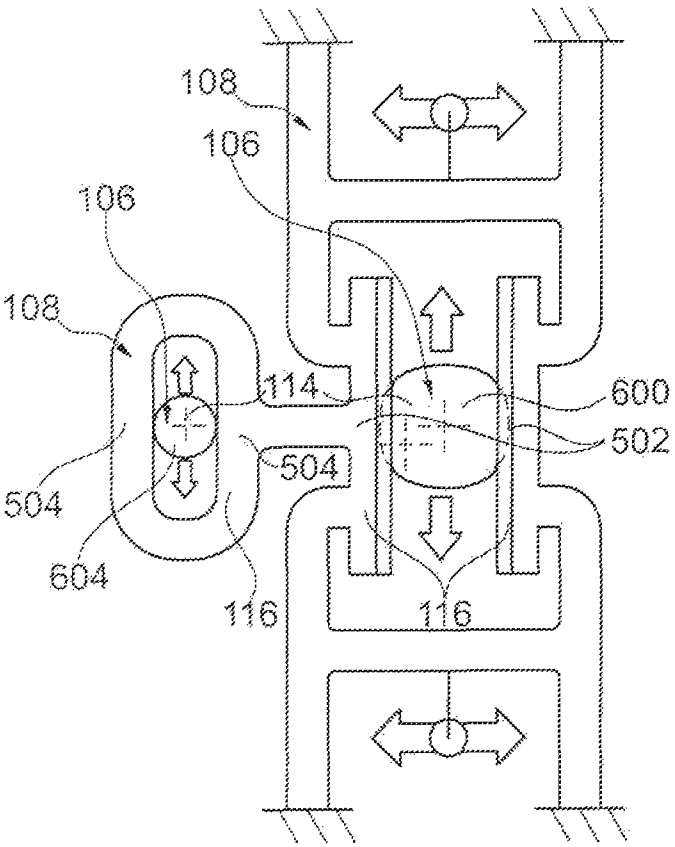

In accordance with FIG. 6 the positioning nubs 604 can align the leaf spring structures 502 with related snap-in elements, such that the snap-in bodies 600 latch securely independently of any deformation/movement in the surface.

In FIGS. 6 to 9 arrows indicate in which directions the various sections of the structures shown are able to undertake compensating movements in the event of temperature variation or for compensating for tolerances caused in manufacture.

Figure 11:
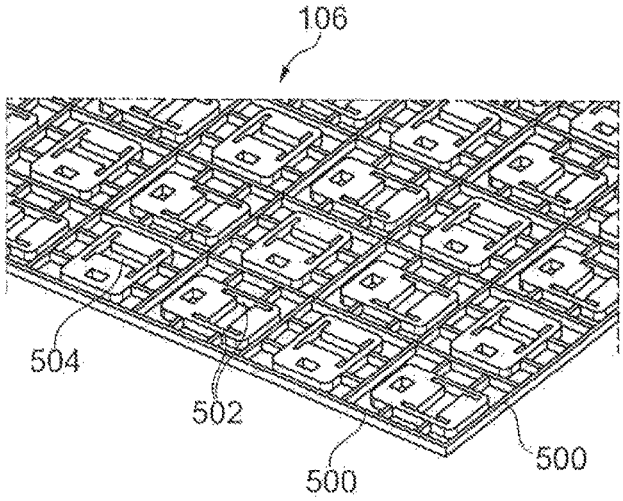
FIG. 10 shows a plan view and FIG. 11 shows a 3D view of a plug connection structure of a substrate installation unit in accordance with an exemplary example of embodiment of the invention.
Figure 10:
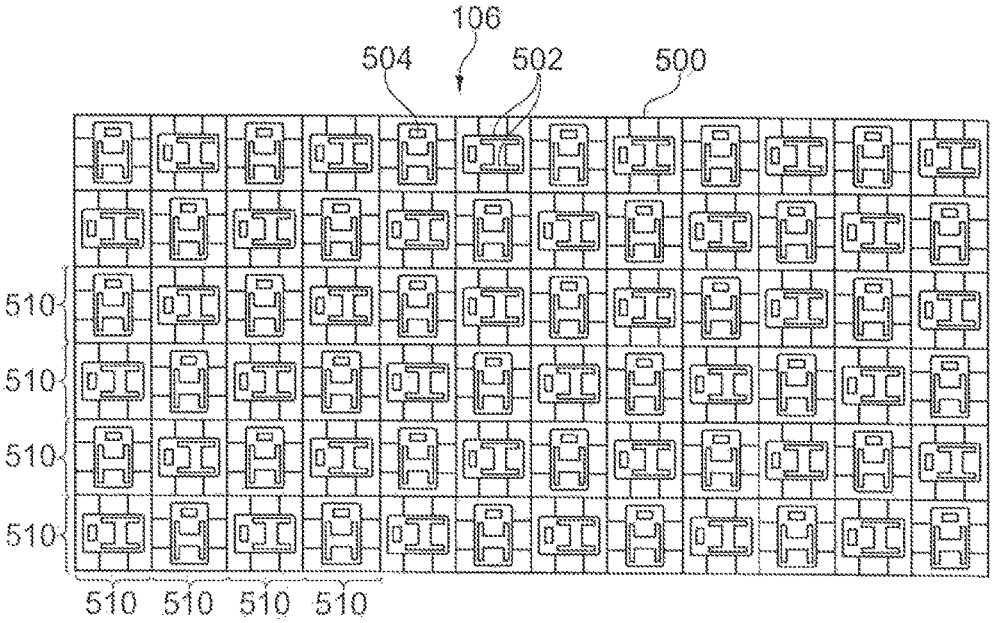

FIG. 10 shows a plan view and FIG. 11 shows a 3D view of a plug connection structure 106 of a substrate installation unit 100 in accordance with an exemplary example of embodiment of the invention.

FIGS. 10 and 11 thus show a base cover, that is to say a substrate installation unit 100, with integrated elements. The segment size can be, for example, 25 mm×25 mm. The grid dimension (i.e. the size of a plug connection unit cell 510) can be, for example, 50 mm×50 mm. A module, i.e. a substrate installation unit 100, can have a size, for example, of 300 mm×150 mm, and a height of 3 mm.

In accordance with FIGS. 10 and 11 the grid is formed as a frame, wherein there are provided positioning elements, fixing elements, longitudinal and transverse spring elements, together with measures for tolerance compensation.

Figure 12:
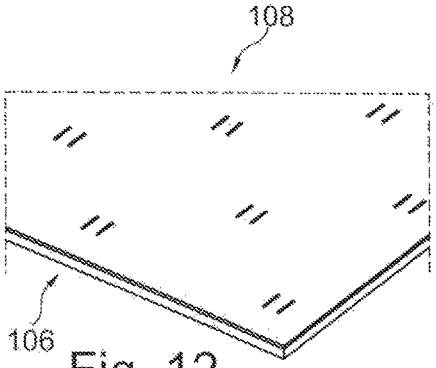
FIG. 12 shows a part of a changeover cover in accordance with an exemplary example of embodiment of the invention.

FIG. 12 shows a part of a changeover cover 150 in accordance with an exemplary example of embodiment of the invention. With reference to FIG. 12, attention is drawn to the contact surface for the attachment structures 104 and 120.

Figure 13:
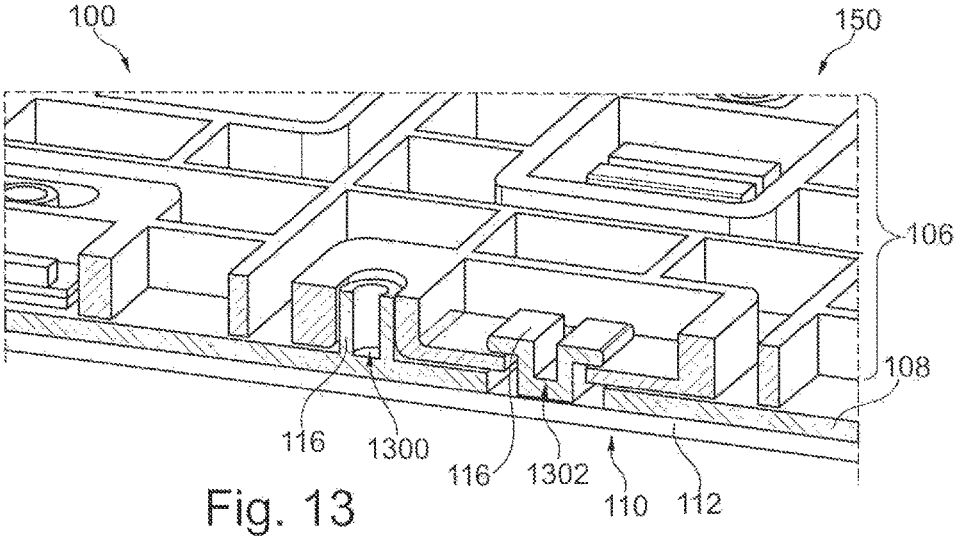
FIG. 13 shows a detail view and FIG. 14 shows an overview of a plug connection between a plug connection structure of a substrate installation unit and a corresponding plug connection structure of a surface installation unit, in accordance with an exemplary example of embodiment of the invention.
Figure 14:
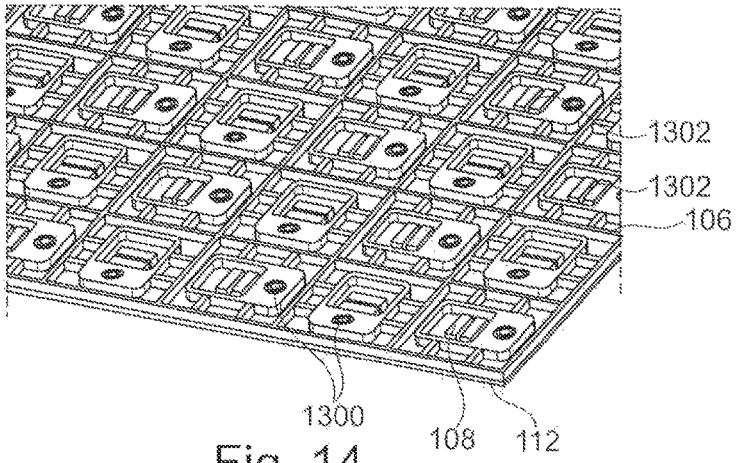

FIG. 13 shows a detail view, and FIG. 14 shows an overview of a plug connection between a plug connection structure 106 of a substrate installation unit 100 and a corresponding plug connection structure 108 of a surface installation unit 110, in accordance with an exemplary example of embodiment of the invention.

In accordance with FIGS. 12 to 14 a combination is shown of a substrate installation unit 100 (also designated as a base cover element) and a surface installation unit 110 (also designated as a changeover cover element). The positioning takes place by means of a positioning pin 1300. The Fixation takes place by means of a snap-in hook 1302. The tolerance compensation takes place by means of sprung connecting elements. The snap-in hook 1302 and the positioning pin 1300 are arranged at a fixed distance from one another.

Figure 15:
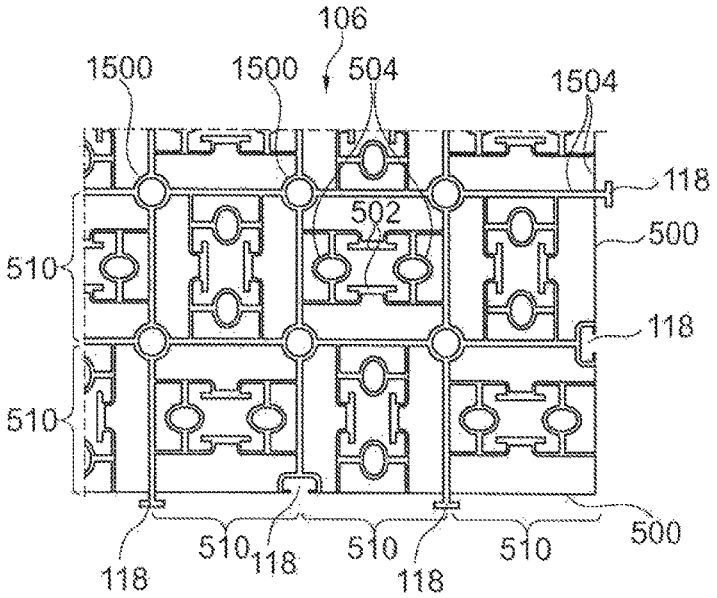
FIG. 15 shows a plan view and FIG. 16 shows a 3D view of a plug connection structure of a substrate installation unit in accordance with yet another exemplary example of embodiment of the invention.
Figure 16:
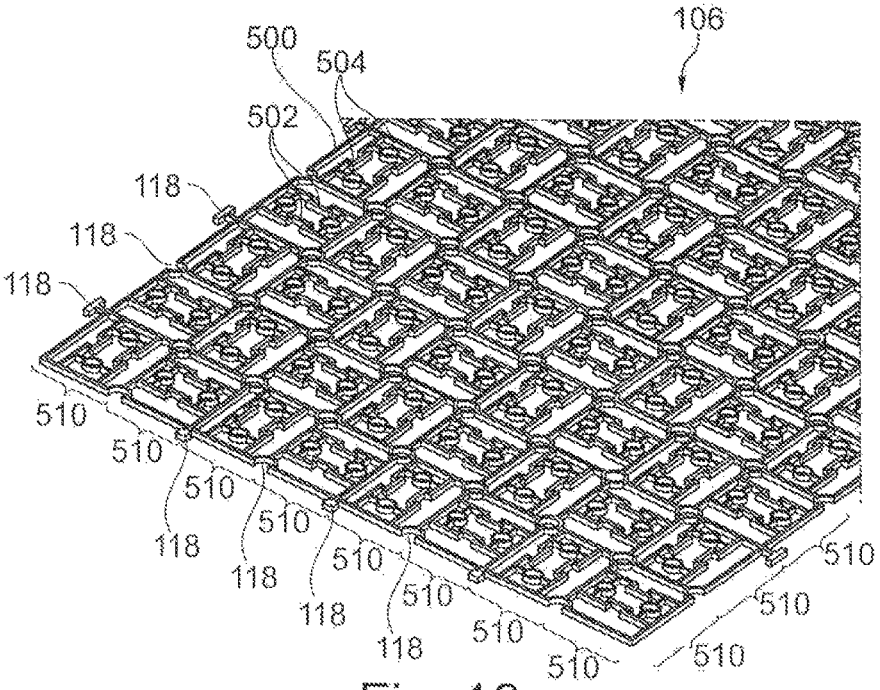

FIG. 15 shows a plan view and FIG. 16 shows a 3D view of a plug connection structure 106 of a substrate installation unit in accordance with yet another exemplary example of embodiment of the invention.

FIGS. 15 and 16 show a substrate installation unit 100 (also designated as a base cover element) with integrated elements. In accordance with this example of embodiment stabilizing ring elements 1500 are provided in the corners of individual plug connection unit cells 510. Elongated holes are formed as guide ring structures 504 for two positioning pins or positioning nubs 604 of a surface installation unit 110 (not shown in FIGS. 15 and 16). In addition, sprung strips are provided as leaf spring structures 502 for snap-in hooks as snap-in bodies 600 (not shown in FIGS. 15 and 16). Tolerance compensation takes place by means of sprung connecting elements in the form of frame struts 1504. The frame struts 1504 are part of the frame structure 500. T-elements for fixing the modules in the surface composite can also be provided. In accordance with the example of embodiment shown the grid dimension (that is to say, the size of a plug connection unit cell 510) can be, for example, 50 mm×50 mm, wherein the module (that is to say, the whole of the substrate installation unit 100), can have a size of 600 mm×200 mm, and a height of 3 mm.

Figure 17:
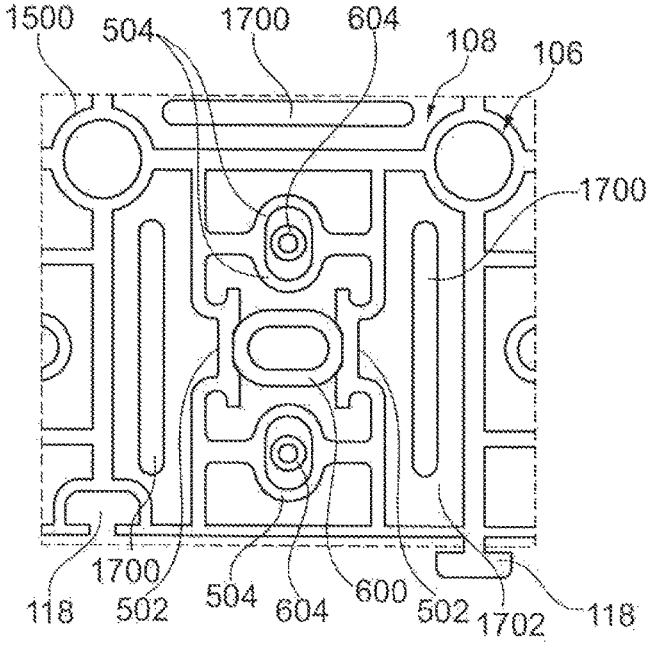
FIG. 17 shows a plan view of a plug connection between a plug connection structure of a surface installation unit and a plug connection structure of a substrate installation unit in accordance with an exemplary example of embodiment of the invention.

FIG. 17 shows a plan view of a plug connection between a plug connection structure 108 of a surface installation unit 110 and a plug connection structure 106 of a substrate installation unit 100, in accordance with an exemplary example of embodiment of the invention. The snap-in bodies 600 and the positioning nubs 604 are designed such that they can accommodate vertical loads.

In accordance with FIG. 17, the snap-in body 600 of the plug connection structure 108 is arranged along a first (in FIG. 17, horizontal) extension direction between two rib-shaped and elongated load-accommodating structures 1700, extending along a second (in FIG. 17, vertical) extension direction. The load-accommodating structures 1700 protrude in a raised manner relative to a flat base panel 1702 of the surface installation unit 110, and are designed so as to accommodate mechanical loads acting on the surface installation unit 110.

Figure 18:
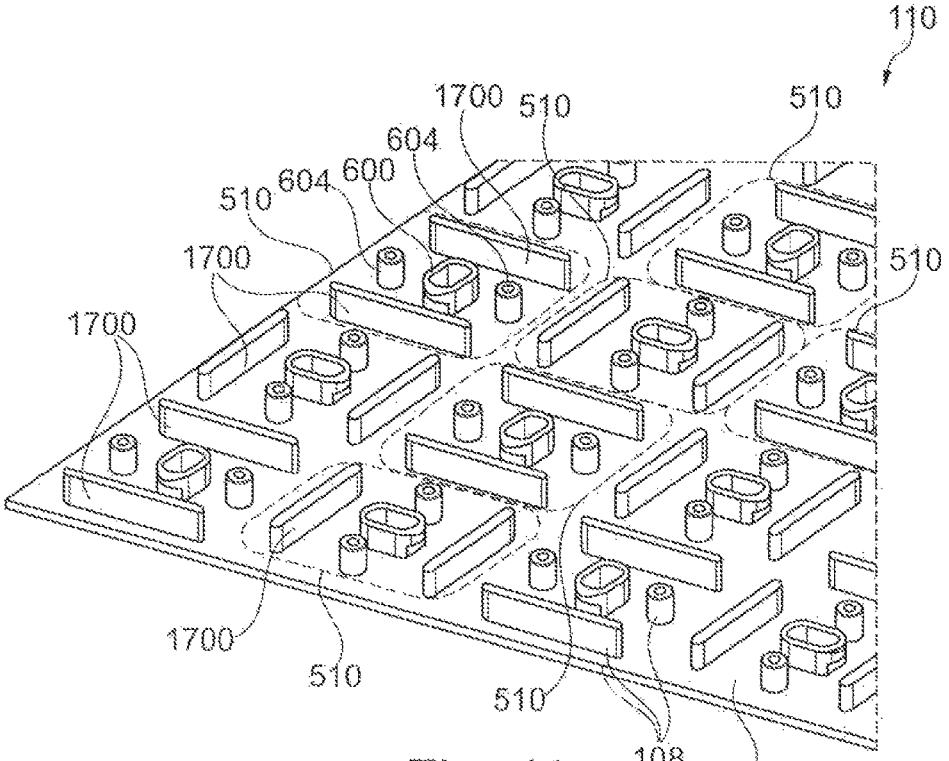
FIG. 18 shows a 3D view of a plug connection structure of a surface installation unit in accordance with an exemplary example of embodiment of the invention.

FIG. 18 shows a 3D view of a plug connection structure 108 of a surface installation unit 110 in accordance with an exemplary example of embodiment of the invention.

The plug connection structure 108 is designed as a two-dimensional periodically repeating grid, with a grid dimension in a range between 10 mm and 100 mm, of plug connection unit cells 510. Stated more precisely, the grid is formed by a two-dimensional, alternating sequence of the plug connection unit cells 510, which extend alternately in a first direction of orientation, and in a second direction of orientation that is orthogonal to the first direction of orientation. In other words, adjacent plug connection unit cells 510 are rotated relative to one another by 90°. Each of the plug connection unit cells 510 is designed as an arrangement of a snap-in body 600 designed as a snap-in ring, two load-accommodating ribs parallel to one another as load-accommodating structures 1700, and a pair of hollow cylindrical positioning nubs 604.

In accordance with FIGS. 17 and 18 a substrate installation unit 110 (also designated as a base cover element) is represented with functional elements. In this case the panel thickness is 1 mm. Two positioning pins are provided as positioning nubs 604, and a snap-in body 600 is provided as a snap-in mandrel element. These snap-in hooks and positioning pins are arranged at a fixed distance from one another. In each case there are two longitudinal ribs per plug connection unit cell 510 for the accommodation of vertical loads.

Figure 20:
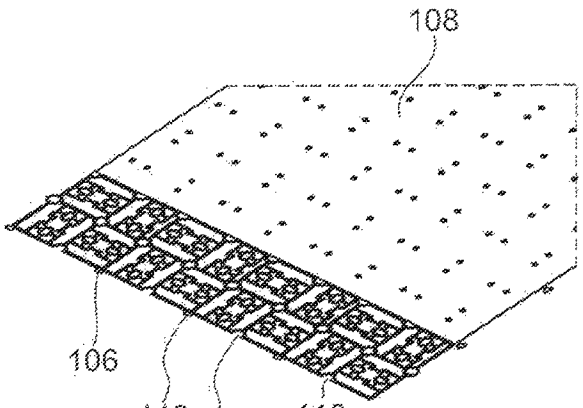
FIGS. 19 to 21 show various 3D views of a plug connection between a plug connection structure of a substrate installation unit and a plug connection structure of a corresponding surface installation unit, in accordance with an exemplary example of embodiment of the invention.
Figure 21:
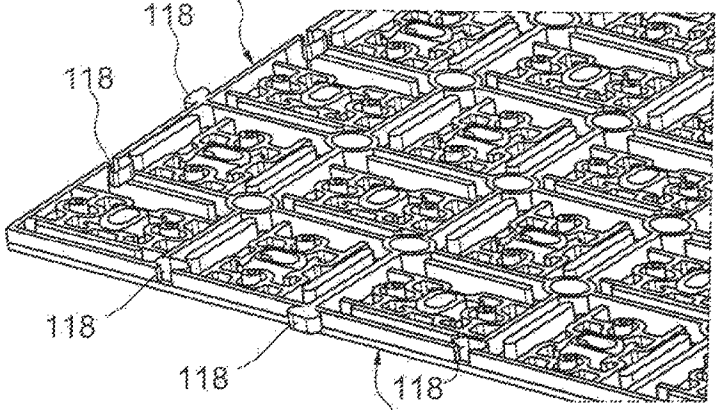
Figure 19:
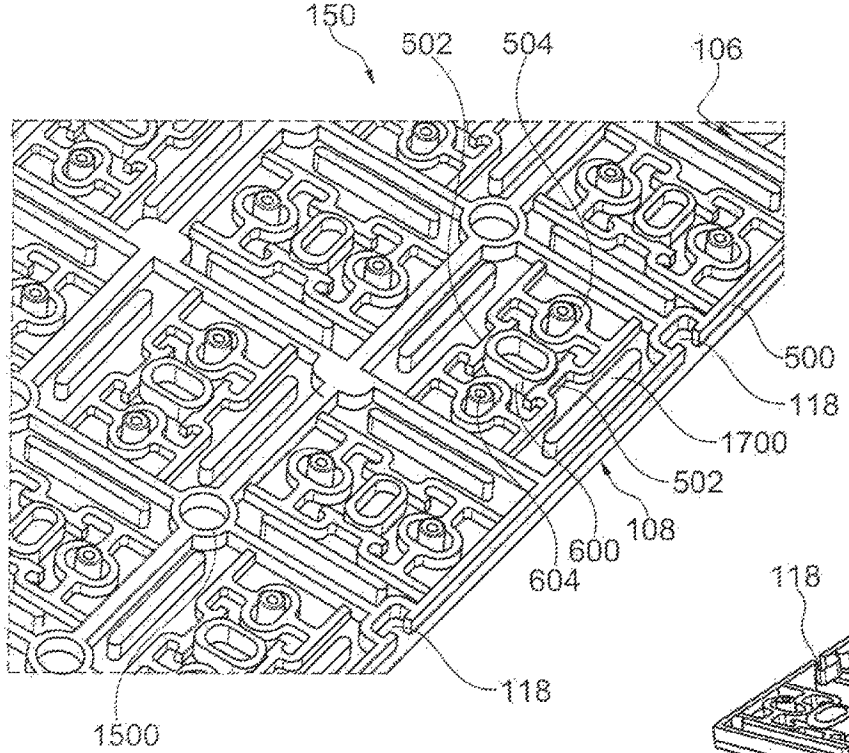

FIG. 19, FIG. 20, and FIG. 21 show different 3D views of a plug connection between a plug connection structure 106 of a substrate installation unit 100 and a plug connection structure 108 of a corresponding surface installation unit 110, in accordance with an exemplary example of embodiment of the invention. FIGS. 19 to 21 thus show a combination of a surface installation unit 110 (also designated as a changeover cover element) and a substrate installation unit 100 (also designated as a base cover element). In the example of embodiment shown the components are provided as injection molded parts. The injection molding molds can be designed without sliders.

Figure 22:
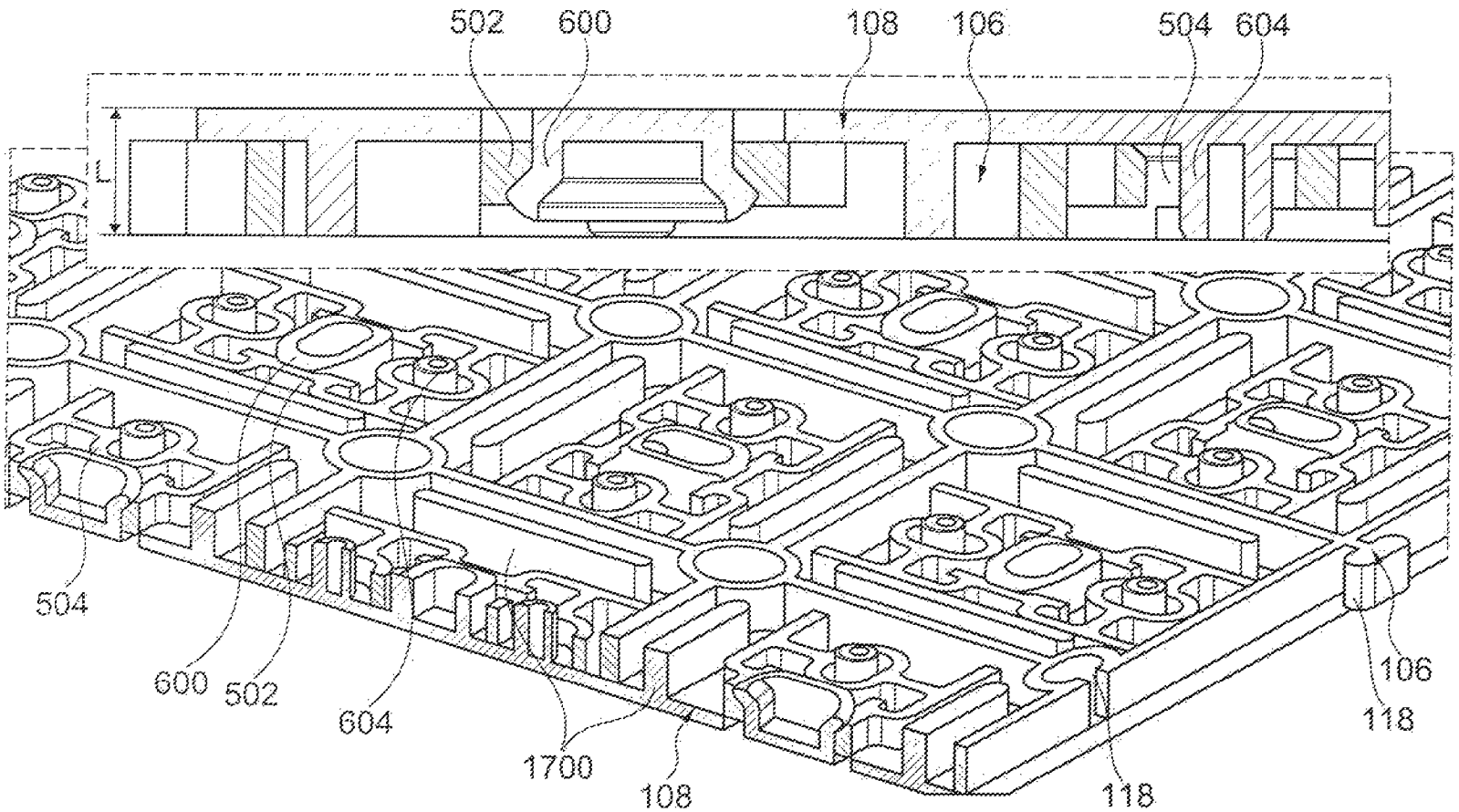
FIG. 22 shows a 3D view and a cross-sectional view of a plug connection between a plug connection structure of a substrate installation unit and a plug connection structure of a corresponding surface installation unit in accordance with an exemplary example of embodiment of the invention.

FIG. 22 shows a 3D view and a cross-sectional view of a plug connection between a plug connection structure 106 of a substrate installation unit 100 and a plug connection structure 108 of a corresponding surface installation unit 110, in accordance with an exemplary example of embodiment of the invention. FIG. 22 shows a cross-sectional view after the formation of a snap-in plug connection, wherein a build height of L=4 mm is represented. In FIG. 22 entry chamfers, together with the flat design of the snap-in plug connection, can also be discerned, which leads to a small build height.

Figure 24:
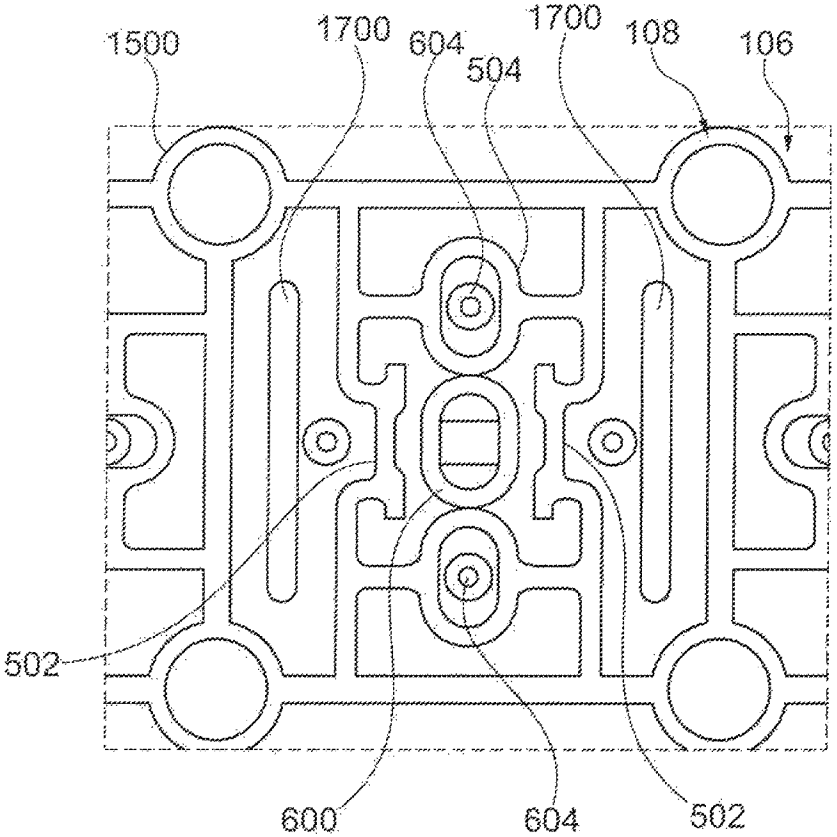
FIG. 24 shows a detail view of a plug connection of a changeover cover in accordance with an exemplary example of embodiment of the invention.
Figure 23:
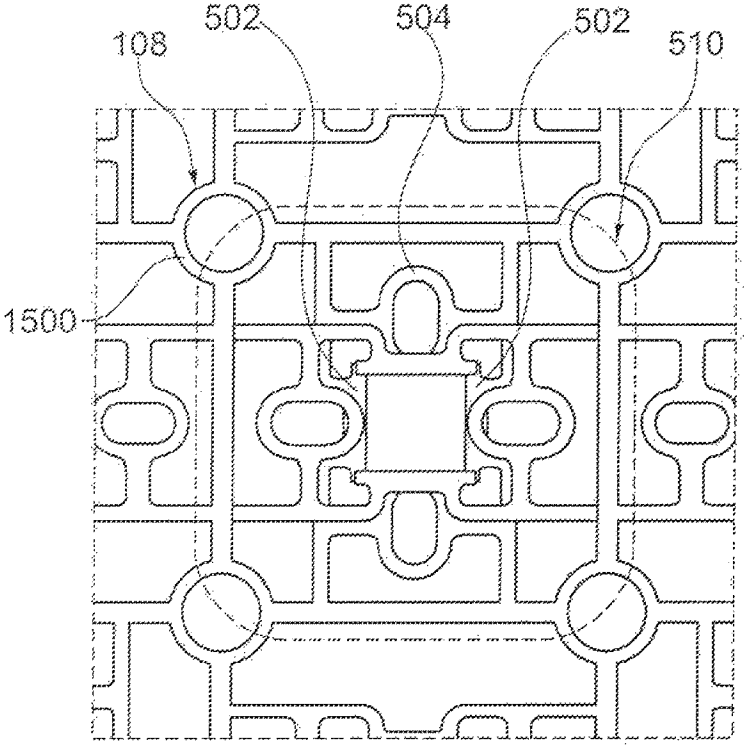
FIG. 23 shows a plug connection unit cell of a plug connection structure of a surface installation unit in accordance with an exemplary example of embodiment of the invention.

FIG. 23 shows a plug connection unit cell 510 of a plug connection structure 108 of a surface installation unit 110 in accordance with an exemplary example of embodiment of the invention. FIG. 24 shows a detail view of a plug connection of a changeover cover 150 in accordance with an exemplary example of embodiment of the invention. FIGS. 23 and 24 show a changeover floor cover system with a grid dimension of 25×25 mm. Four positioning pins or positioning nubs 604 are provided, as is a double-acting snap-in mandrel as a snap-in body 600, in each plug connection unit cell 510. Snap-in hooks and positioning pins are geometrically optimized. Ring elements (see reference symbol 1500) are embodied in the corners as support elements. FIG. 23 represents how, by means of a snap-in body 600 corresponding to FIG. 24, which acts in two directions, the grid dimension can be halved. The leaf spring structures 502 represented are, for example, rotated through 90°, Corresponding positioning nubs 604 can advantageously be embodied four times.

It is to be noted that in all the examples of embodiment in accordance with FIGS. 5 to 24, the respective plug connection structure 106 can alternatively be embodied as a plug connection structure of the surface installation unit 110, and the respective plug connection structure 108 can alternatively be embodied as a plug connection structure of the substrate installation unit 100. In other words, the plug structures 106 and 108 can be interchanged with each other.

It is also to be noted that "having" does not exclude any other elements or steps, and "a" or "an" does not exclude a multiplicity of items. Furthermore it is to be noted that features or steps that have been described with reference to one of the above examples of embodiment can also be used in combination with other features or steps of other above-described examples of embodiment. Reference symbols in the claims are not to be seen as any limitation.

LIST OF REFERENCE SIGNS

100 Substrate installation unit
102 Substrate
104 Attachment structure
106 Plug connection structure
108 Plug connection structure
110 Surface installation unit
112 Utilization structure
114 Plug connection elements
116 Plug connection elements
118 Coupling structure
120 Attachment structure
130 Floor heating system
142 Connecting layer
144 Compensating layer
150 Changeover cover
200 Functional structure
202 Functional structure
300 Functional structure installation unit
302 Plug connection structure
304 Plug connection structure
306 Functional structure
500 Frame structure
502 Leaf spring structures
504 Guide ring structures
510 Plug connection unit cells
600 Snap-in bodies
604 Positioning nubs
1300 Positioning pin
1302 Snap-in hook
1500 Ring elements
1504 Frame struts
1700 Load-accommodating structures
1702 Baseplate

What is claimed is:

1. A substrate installation unit for installing with other substrate installation units, for covering a substrate, wherein the substrate installation unit comprises:

a substrate-side attachment structure, which is designed for attaching to the substrate; and a plug connection structure facing away from the substrate, for releasably plug connecting with a formation of a snap-in plug connection, with a correspondingly designed plug connection structure of a surface installation unit;

wherein the plug connection structure comprises a number of plug connection elements which protrude in a raised manner relative to the substrate-side attachment structure;

wherein the substrate installation unit comprises at least one of the following features:

the plug connection elements comprise positioning nubs, which are configured for engaging, enabling a compensating movement, in corresponding guide ring structures of the plug connection structure of the corresponding surface installation unit; or the plug connection structure is designed as a two-dimensional periodically repeating grid of plug connection unit cells and the grid is formed by a two-dimensional, alternating sequence of the plug connection unit cells, which extend alternately in a first direction of orientation, and in a second direction of orientation that is orthogonal to the first direction of orientation; and wherein the plug connection elements comprise a snap-in body for forming a snap-in plug connection with corresponding leaf spring structures of the plug connection structure of the corresponding surface installation unit.

2. The substrate installation unit as set forth in claim 1, wherein the positioning nubs align leaf spring structures with related snap-in elements, such that the snap-in body latches securely independently of any deformation and/or movement within an extension plane of the substrate installation unit.

3. The substrate installation unit as set forth in claim 1, further comprising at least one of the following features:

load-accommodating ribs, which are arranged between the plug connection elements, protrude in a raised manner relative to the substrate-side attachment structure, and are designed for accommodating mechanical loads acting on the substrate installation unit; or the snap-in body, in a first extension direction comprises a larger dimension than in a second extension direction that is orthogonal to the first, wherein along the first extension direction the snap-in body, is arranged between two load-accommodating structures extending along the second extension direction, wherein along the second extension direction the snap-in body, is arranged between two positioning nubs.

4. The substrate installation unit as set forth in claim 1, wherein the substrate installation unit comprises at least one of the following features:

a respective plug connection unit cell is formed by an arrangement of a snap-in body, load-accommodating structures, and positioning nubs; or the plug connection structure comprises a number of plug connection elements; or a vertical thickness in a range between 0.5 mm and 10 mm.

5. The substrate installation unit as set forth in claim 1, further comprising at least one of the following features:

a dovetail structure or a coupling structure for fixation along five different spatial directions, in at least one edge region of the substrate installation unit, which is designed for coupling with a corresponding coupling structure of another substrate installation unit; or the substrate-side attachment structure is designed so as to attach the substrate installation unit to the substrate in a point-form bonding, line-form bonding, or full-surface bonding.

6. The substrate installation unit as set forth in claim 1, further comprising a functional structure between the plug connection structure and the substrate-side attachment structure.

7. A surface installation unit installing with other surface installation units on substrate installation units for forming a changeover cover, wherein the surface installation unit comprises:

a utilization structure, which forms an exposed outer surface of the changeover cover; and a plug connection structure facing away from the utilization structure for releasably plug connecting with the formation of a snap-in plug connection, with a correspondingly designed plug connection structure of the substrate installation units, which comprise a substrate-side attachment structure, wherein the plug connection structure is designed as a frame structure, consisting of strips connected together, with a number of plug connection elements integrated therein;

wherein the surface installation unit comprises at least one of the following features:

the plug connection elements comprise guide ring structures, which are configured for accommodating, enabling a compensating movement, corresponding positioning nubs of the plug connection structure of the corresponding substrate installation unit; or the plug connection structure is designed as a two-dimensional periodically repeating grid of plug connection unit cells and the grid is formed by a two-dimensional alternating sequence of the plug connection unit cells, which extend alternately in a first direction of orientation, and in a second direction of orientation that is orthogonal to the first direction of orientation.

8. The surface installation unit as set forth in claim 7, further comprising at least one of the following features:

the utilization structure comprises a thickness in a range between 0.5 mm and 10 mm; or two plug connection elements opposing one another, comprise leaf spring structures, which are configured for forming a snap-in plug connection with a snap-in body, of the plug connection structure of the corresponding substrate installation unit.

9. The surface installation unit as set forth in claim 7, further comprising at least one of the following features:

leaf spring structures designed so as to provide a spring function in a spring direction, which is arranged so as to be essentially orthogonal with respect to a compensating movement direction of the guide ring structures; or a respective plug connection unit cell is formed by an arrangement of leaf spring structures and guide ring structures.

10. The surface installation unit as set forth in claim 9, wherein the plug connection structure comprises a number of plug connection elements, which are designed with features of the plug connection elements.

11. The surface installation unit as set forth in claim 7, further comprising at least one of the following features:

a vertical thickness in a range between 1 mm and 10 mm; or a functional structure that is integrated into the utilization structure and is designed as a wear protection layer; or the utilization structure comprises a plug connection structure-side support structure, and an external utilization coating formed thereon.

12. A changeover cover for covering a substrate, wherein the changeover cover comprises:

a number of substrate installation units as having a plug connection which together are designed for an essentially gap-free, covering of the substrate;

a number of surface installation units as recited in claim 7 which are designed for an essentially gap-free, covering of the substrate installation units, which are covering the substrate;

wherein the plug connection structure of the substrate installation units and the plug connection structure of the surface installation units are matched to one another in such a manner that they can be brought into a plug-in engagement with one another with the formation of a snap-in plug connection.

13. The changeover cover as set forth in claim 12, wherein the plug connection structure of the surface installation units and the plug connection structure of the substrate installation units are matched to one another such that with the formation of a releasable plug connection a snap-in process takes place between the plug connection structures exclusively in a plane that is arranged parallel to the utilization structure.

14. The changeover cover as set forth in claim 12, wherein the plug connection structure of the surface installation units comprise a higher bending stiffness than the plug connection structure of the substrate installation units.

* * * * *